United States Patent [19]

Barrett

[11] Patent Number: 4,864,595

[45] Date of Patent: Sep. 5, 1989

[54] TRANSPORT INTEGRATED FOOD IRRADIATOR, CANISTERS USED WITH FOOD IRRADIATOR, AND METHOD OF IRRADIATING FOOD

[76] Inventor: Lawrence G. Barrett, 3223 Downing Dr., Lynchburg, Va. 24503

[21] Appl. No.: 909,221

[22] Filed: Sep. 19, 1986

[51] Int. Cl.[4] ..... G21K 5/10

[52] U.S. Cl. ..... 378/69; 378/68; 378/64; 426/234

[58] Field of Search ..... 378/51, 64, 68, 69; 414/32, 273, 392, 399; 250/359.1, 453.1, 454.1, 455.1, 492.1, 492.3; 426/234, 240; 206/504; 220/23.2, 23.4

[56] References Cited

U.S. PATENT DOCUMENTS

| | | | |
|---|---|---|---|
| 997,300 | 7/1911 | Kirchner | 220/23.2 |
| 1,856,084 | 5/1932 | Smith | 378/69 |
| 1,981,583 | 11/1934 | Craig | 378/64 |
| 3,162,320 | 12/1964 | Hitch et al. | 220/23.4 |
| 3,177,121 | 4/1965 | Horowitz et al. | 376/341 |
| 3,452,195 | 6/1969 | Brunner | 378/69 |
| 3,519,817 | 7/1970 | Brunner | 250/436 |
| 3,566,113 | 2/1971 | Balanca et al. | 378/69 |
| 3,604,934 | 4/1971 | Melillo | 378/69 |
| 3,641,342 | 2/1972 | Armel et al. | 378/69 |
| 3,686,502 | 8/1972 | Sieber | 378/69 |
| 3,851,936 | 12/1974 | Muller | 220/23.4 |
| 3,853,230 | 12/1974 | Schultz | 414/392 |
| 4,172,019 | 8/1979 | Woodbridge | 378/67 |
| 4,481,652 | 11/1984 | Ransohoff | 378/69 |
| 4,760,264 | 7/1988 | Barrett | 250/453.1 |
| 4,788,701 | 11/1988 | Barrett | 378/69 |

FOREIGN PATENT DOCUMENTS

| | | | |
|---|---|---|---|
| 2147088 | 3/1973 | Fed. Rep. of Germany | 378/69 |
| 3306348 | 8/1984 | Fed. Rep. of Germany | 220/23.4 |
| 3404453 | 8/1985 | Fed. Rep. of Germany | 220/23.4 |
| 0493167 | 2/1973 | U.S.S.R. | 378/64 |
| 0605475 | 12/1982 | U.S.S.R. | 378/64 |

OTHER PUBLICATIONS

"Irradiation, Plants for Foodstuffs" by Lüscher Sulzer Technical Review 4–1977.

*Primary Examiner*—Craig E. Church
*Assistant Examiner*—John C. Freeman
*Attorney, Agent, or Firm*—Sandler & Greenblum

[57] ABSTRACT

The present invention provides a system of irradiating food products in product-containing canisters. The canisters are adapted to retain a plurality of cartons of food product. The canisters are initially positioned on the trailer bed of a truck or similar vehicle and are taken to an unloading station. The canisters are preferably unloaded in pairs from the station and are conducted underground to an irradiator building. The irradiator building includes elevators for lifting the canisters into an irradiation path where the canisters are conducted past a plurality of radiation source plaques. The canisters can then lowered by a second elevator within the irradiator to a position underground, where they are conducted by a third conveyor to a loading station. The irradiated canisters are then loaded onto a truck bed and taken to their ultimate destination.

31 Claims, 16 Drawing Sheets

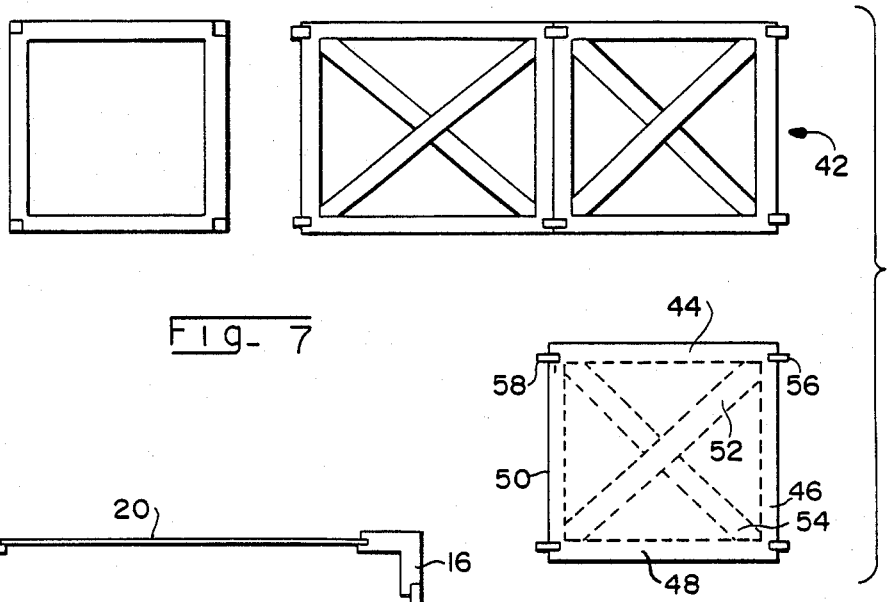
Fig. 7
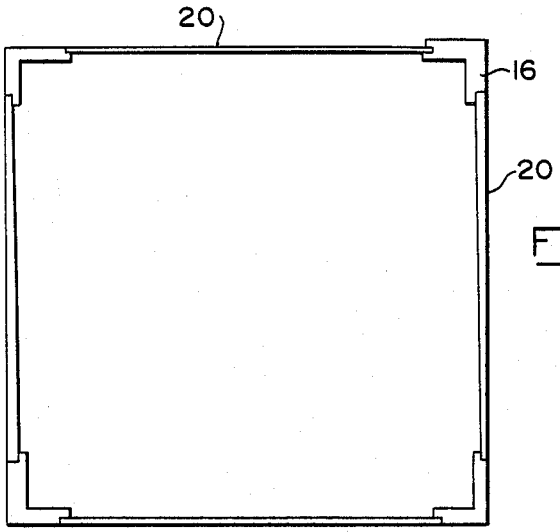
Fig. 2
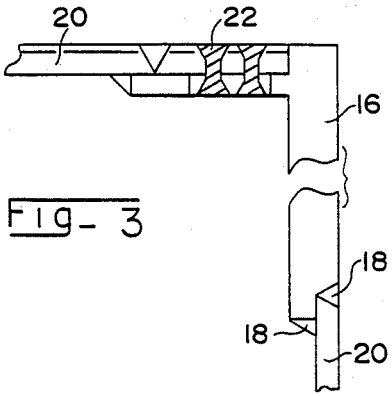
Fig. 3
Fig. 1
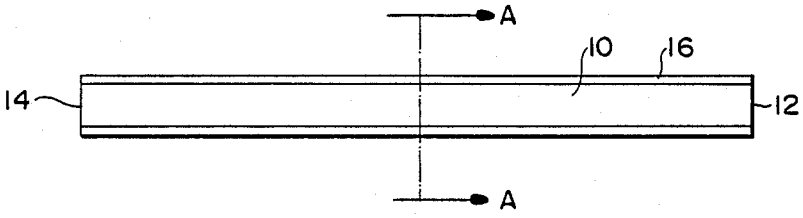

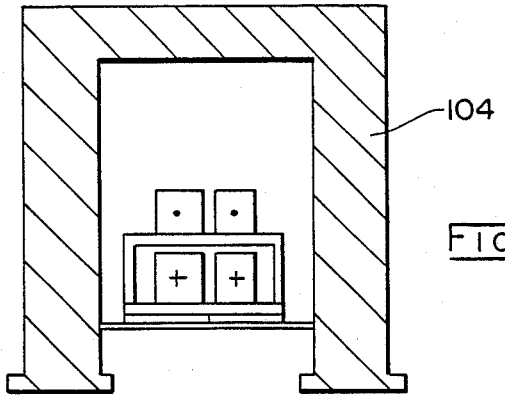
Fig- 13
Fig- 14
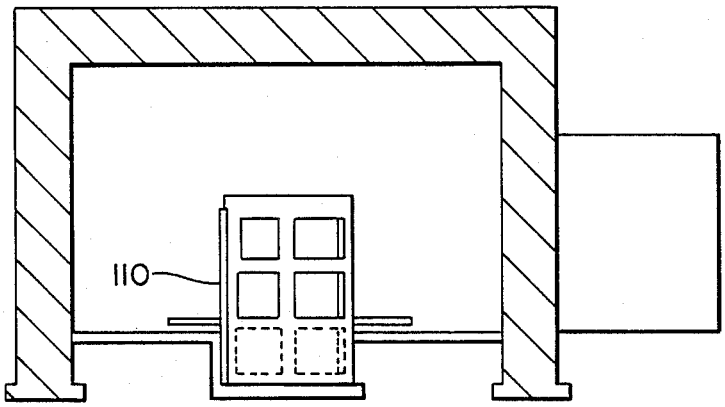

LEVEL 0
I
II
110
112
114
116
118
120
85
86
84a
84b
1
4
5

Fig-24
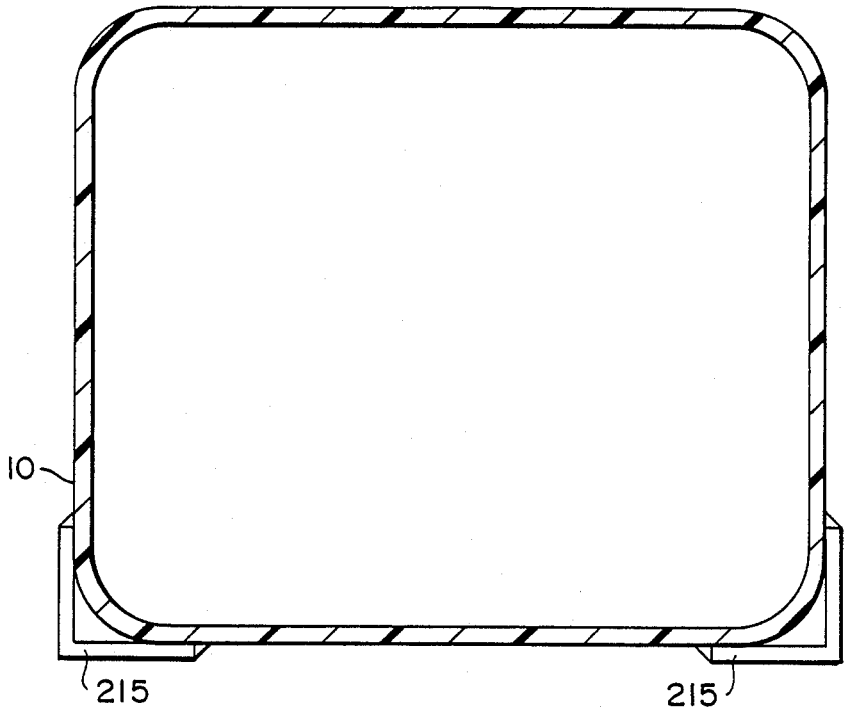
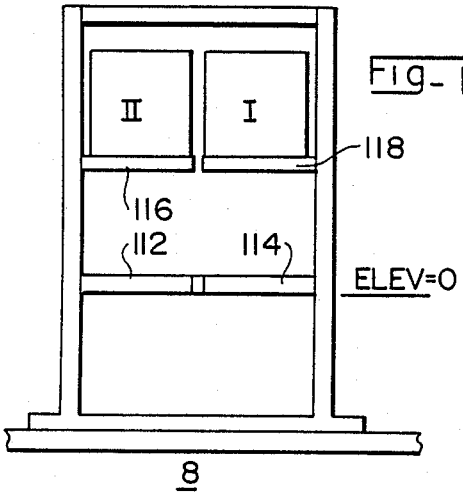
Fig-15i
Fig-15h
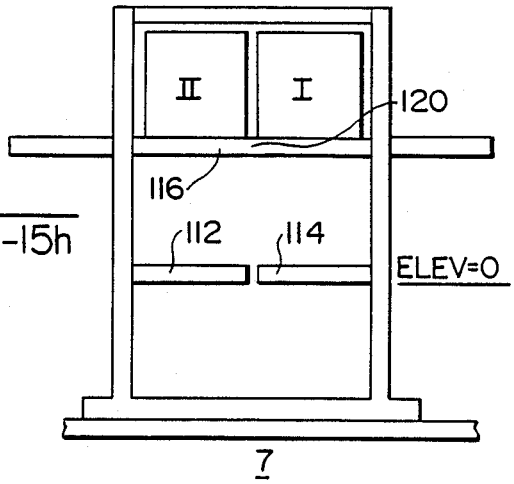
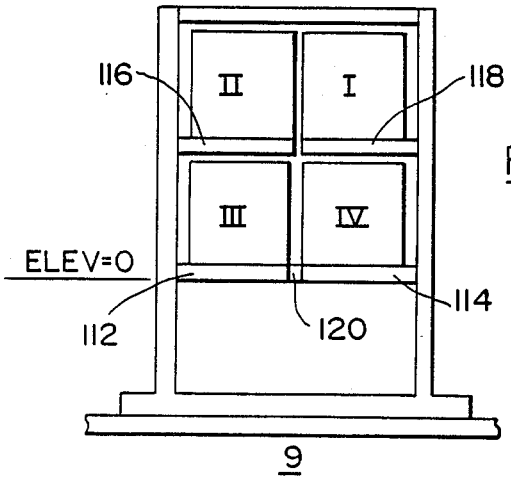
Fig-15j

Fig-17
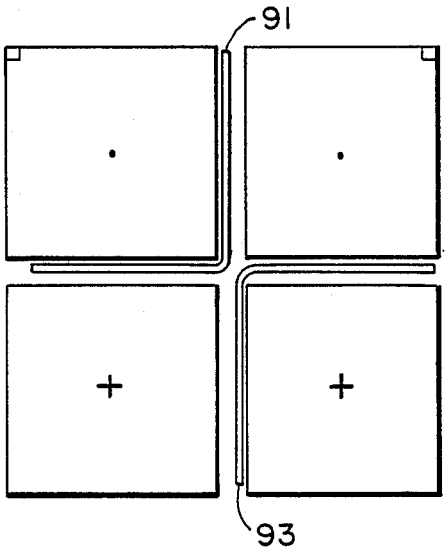
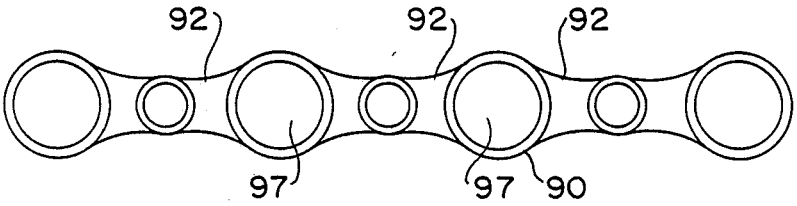
Fig-18
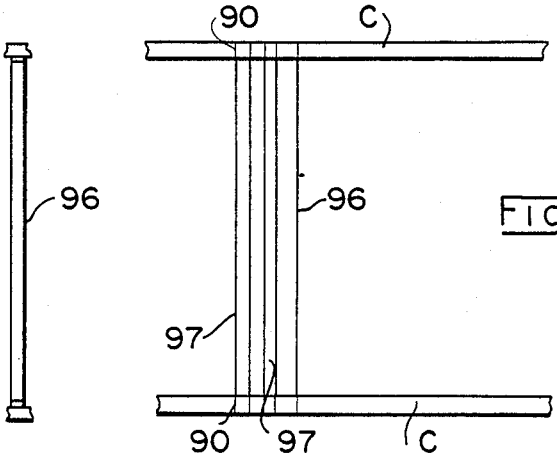
Fig-19
Fig-20
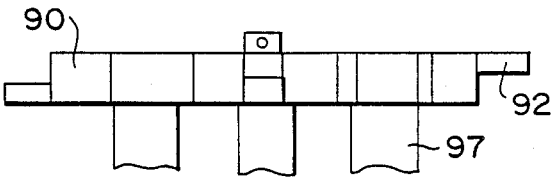

Fig- 22
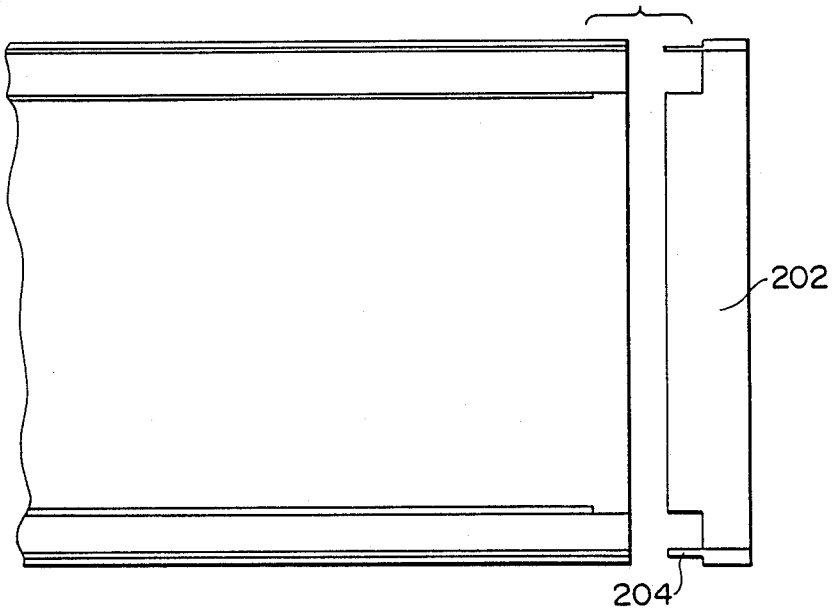
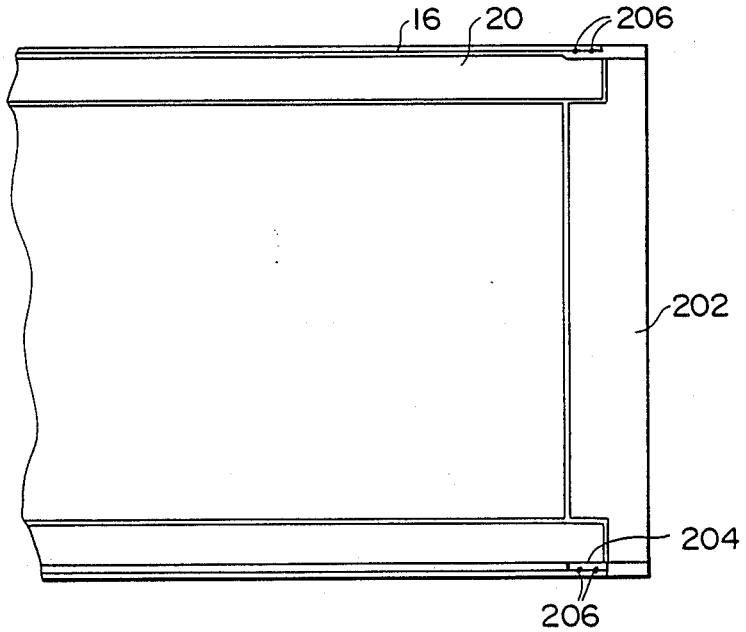
Fig-23

TRANSPORT INTEGRATED FOOD IRRADIATOR, CANISTERS USED WITH FOOD IRRADIATOR, AND METHOD OF IRRADIATING FOOD

BACKGROUND OF THE DISCLOSURE

1. Field of the Invention

The present invention generally relates to apparatus and methods for the irradiation of both food and non-food products, and more specifically to an apparatus and method for irradiating food which includes an integrated transport and irradiation system for irradiating large quantities of produce and other food products.

2. Discussion of Prior Art

The irradiation of food has developed as an industry over a period of approximately 30 years. At the present time, FDA regulations have been promulgated for irradiating wheat, wheat flour, potatoes, pork, and produce. These regulations provide for giving absorbed radiation doses to food (other than spices) of up to 100 kilorads. It is expected that eventually many additional foods will be cleared for irradiation for preservation and other beneficial purposes, in addition to disinfestation purposes. A wide spectrum of food products will be covered under such regulations, including, e.g., meats and poultry. It is expected that any approval given by FDA to irradiate for such purposes will permit foods to be exposed to higher levels of radiation than are now used for disinfestation in order to achieve the desired beneficial purposes.

It is common in the design of irradiators to utilize radioisotopic sources, e.g., Cobalt-60 and Cesium-137. Recently, Cesium-137 sources have been made available through the Department of Energy; and these sources are generally in the form of WESF capsules containing 40–50 kilocuries.

Standard irradiators are generally designed to accommodate existing standardized packaging for given food products. As a result, these designs generally provide for a pallet containing a plurality of cartons of packaged food products which are adapted to be disassembled, with the cartons thereafter being individually fed through the irradiator; and, upon completion of an irradiation process, the cartons are re-palletized. During the course of irradiation, the cartons of products will be conducted over multiple passes in which they are exposed to gamma-irradiation in various dose distributions, such that the cumulative effect of the radiation is to irradiate all of the product within the container to a minimum dose level which will be sufficient to kill or sterilize appropriate insects in various stages of life. The irradiator design is required to provide less than a maximum dose level to the product so as to be safely within FDA regulatory imposed limits; as well as to minimize any deleterious effects to the food, such as phytotoxicity which will adversely effect citrus fruits.

In handling such cartons of material, additional costs are required for labor, machinery and equipment necessary to de-palletize the cartons, to handle the cartons individually, and to place the cartons on and remove them from a conveyor system, as well as to re-palletize the cartons on pallets after taking them from the conveyor.

Conventional irradiator devices have been adequate in meeting minimum and maximum dose requirements to food products while efficiently utilizing radiation from the radioisotopic sources. To obtain higher efficiency irradiators, it is necessary that the cartons be positioned on a conveyor in a substantially continuous fashion so that the length of travel of the cartons through the irradiator, and any unnecessary delays, will be minimized. Conventional irradiator designs are thus fairly complex in their conveyor and transport mechanisms. Additionally, conventional irradiator apparatus include an undesirably large number of moving parts, e.g., pneumatic cylinders, and there are consequently problems of radiation damage to the components and to lubricants for the components, which create increased maintenance problems.

Recently, the Environmental Protection Agency has banned the use of ethylene dibromide for use on citrus fruits, and it therefore appears that the most viable substitute to the disinfestation of citrus fruits will be irradiation processing. The throughput requirements for irradiators having a size capable of handling significant percentages of citrus fruit crops will have to be quite large, and it is likely that throughputs on the order of 100,000 pounds per hour may be required.

Conventional irradiation systems, which depend upon conveyors and complicated travelling product conveying mechanisms to move cartons and food products, would thus be stressed to extremely high limits with respect to the amount of material which may need to be processed, e.g., a conventional irradiator designed to handle 100,000 pounds per hour of grapefruit would have to handle 2,500 cartons per hour, i.e., approximately 40 cartons per minute. Conventional systems which are forced to handle cartoned products at such a rate will ultimately and undesirably damage cartons and create potential interference with the radioisotopic sources within the irradiator as the cartons move through the irradiator. Further, the mechanical design limitations imposed on systems processing such a large number of products may extend the system beyond the upper limits of appropriate mechanical design.

To accommodate such large throughputs, irradiator designs have been developed which eliminate the labor, machinery and equipment necessary to de-palletize and re-palletize products. Such irradiators are designed to automatically move entire pallets through shielding labyrinths to an irradiator source, at which time food products become irradiated on all four sides of the pallet. Upon completion of such four-sided irradiation, the pallets are automatically removed from an irradiation cell and are then placed on an outgoing truck. Such systems provide considerable savings in operating costs in comparison to the de-palletization and re-palletization systems; however, even these pallet-moving irradiator systems require relatively high labor costs for unloading and loading tractor-trailers. Once again, for throughputs of 100,000 pounds of product per hour and higher, approximately 100 pallets per hour must be processed, again putting substantial mechanical stress on any system which is designed to move such a large number of pallets. Such a system would be forced to handle two and one-half trailer loads of pallets per hour, and thus substantial material handling apparatus, e.g., loading docks, would be necessary to handle pallets at such a volume and rate. Such structure will also be unwieldy and expensive to operate.

Additionally, irradiator designs used to irradiate pallets of material require larger cell spaces than previous devices. Such larger cell spaces increase to a significant degree the amount of concrete required for the radiation shielding needed to surround such cell space. In addition, the solid angle intercepted by pallets as they are irradiated from the source is substantially reduced in comparison to the solid angle over which the cartons are conducted in carton-type irradiators. Thus, the solid angle intercepted by the pallet lowers the irradiation efficiency of utilizing radioisotopic source materials in such systems.

Accordingly, the present invention is designed to provide a transport integrated irradiation apparatus and method which overcomes many of the deficiencies of both carton-type and pallet-type conventional irradiators. The present invention will comprise a plurality of container units, i.e., irradiation canisters, which will be sufficiently large that they can receive up to approximately 10,000 pounds of produce or other foods to be irradiated. The total cost involves about one-third for irradiation, one-third for palletizing and de-palletizing, and about one-third for loading and unloading. The present system is designed to eliminate the charge for carton and/or pallet truck unloading and reloading which is inherent in the systems referred to above, as well as the charge for de-palletizing and re-palletizing cartons which is inherent in the carton system discussed above. This will leave a relatively inexpensive charge of about one-third of the overall cost of the carton system for irradiating food in accordance with the present invention.

OBJECTS OF THE PRESENT INVENTION

Accordingly, a general object of the present invention is to provide a new and improved transport integrated irradiating system and method of irradiating products, e.g., food produce, which minimizes the problems of the prior art irradiators, eliminates the need to de-palletize and re-palletize products, minimizes the amount of irradiator cell space required, and reduces the amount of manpower and the cost of irradiating large quantities of food products.

Another object of the present invention is to provide a new and improved transport irradiation system and method for irradiating food which utilizes canisters which will each retain approximately 10,000 pounds of produce.

Still a further object of the present invention is to provide a new and improved transport integrated irradiating system and a method of irradiating food in which a plurality of different sized canisters can be used to retain large amounts of food in order to accommodate various product packing densities and different products.

Still another object of the present invention is to provide a new and improved transport integrated irradiating system and method of irradiating food which utilizes large canisters for holding food products, the canisters being formed from low gamma-ray absorption cross-sectional materials.

Yet another object of the present invention is to provide a new and improved transport integrated food irradiation system and method of irradiating food products in which the food products are positioned in canisters which can be used to either accelerate or to inhibit product ripening, and which are capable of efficiently shipping large amounts of food, e.g., produce.

Still a further object of the present invention is to provide a new and improved transport integrated food irradiation system and method of irradiating food in which an irradiator is used which is adapted to accommodate a large canister as its product carrier, which canister will be capable of receiving a wide intended range of maximum and minimum dosages as required by government regulations and customer needs.

Still another object of the present invention is to provide a new and improved transport integrated irradiation system and method of irradiating food which does not subject food products to crushing or damaging pressures or loads, and which is designed to minimize air gaps between food products stored in canisters which are to be irradiated.

Another object of the present invention is to provide a new and improved transport integrated irradiation system in which product containing canisters are provided with substantially flush exterior surfaces to enhance alignment and transport of the canisters onto and off of trucks, and to provide similarly flush interior surfaces to permit the smooth passage of product and product containing cartons into and out of the canister.

Another object of the present invention is to provide a new and improved transport integrated irradiation system in which the unloading and/or loading building(s) are spaced from the irradiator building so that a continuous process results in which loading of irradiated product, unloading of product prior to irradiation, and irradiation of product can all occur simultaneously; in which loading and unloading operations can be performed by personnel without exposure to radiation; in which the irradiator building need not be in the form of a labyrinth, obviating the need for an unduly large radiator building for loading, unloading and radiating forty foot long canisters; and which reduces the cost of safely irradiating large canisters while shielding personnel from radiation.

The above and other objects, features and advantages of the present invention will be more fully described hereinafter with respect to the detailed description of the drawings which follows.

SUMMARY OF THE INVENTION

The present invention is therefore provided in a first aspect thereof by an irradiator including a path for conducting product-containing canisters, said irradiator comprising an entry opening below ground level for receiving said canisters from a first conveyor. A first elevator raises said canisters from said first conveyor located below ground, said first elevator being located adjacent said entry port. The irradiator includes a primary irradiation zone for irradiating said canisters, said primary irradiation zone being located along a central longitudinal portion of said irradiator between said first and second end walls. A second conveyor is positioned over substantially the entire length of said irradiator and comprises means for transporting said canisters through said primary irradiation zone; and the second conveyor includes means for transposing the relative positions of said canisters on said second conveyor when said canisters are transported through said irradiation zone. A second elevator is provided for lowering said canisters to an exit opening below ground level, and a third conveyor is located below ground level adjacent said exit opening; this exit opening comprises means for permitting said canisters to travel from said irradiator, along said third conveyor, to a loading and unloading building.

The first elevator comprises means for simultaneously raising a first canister and a second canister to said second conveyor, said second elevator also comprising means for lowering said first and second canisters simultaneously from said second conveyor to said third conveyor. The primary irradiation zone includes an irradiation source comprising means for emitting radiation, an irradiation source storage pool for selectively storing said irradiation source, and means for vertically moving said radiation source between an inoperative position within said radiation source storage pool and an operative position upwardly from said radiation source pool.

The radiation source means comprises at least two partially vertically positioned source holding plaques, each of said plaques holding a plurality of rod-like source elements, said plaques together comprising means for irradiating sidewalls of between two and four canisters simultaneously; and at least two substantially horizontally positioned source element sections comprising means for simultaneously irradiating the bottom walls of two canisters positioned on an upper level of said second conveyor above said horizontal source plaque sections and the top walls of two canisters on a lower level of said second conveyor located below said horizontal source plaque sections.

A first set of pulleys and cables are provided to which at least one of said source plaques are attached, said first set of pulleys and cables comprising means for vertically raising and lowering said source plaques between said operative and said inoperative radiation positions, said irradiator further comprising a second set of pulleys and cables comprising means for raising a second one of the source plaques between inoperative and operative irradiation positions. Each of said source plaques comprises a plurality of chain links connected by joints to form a chain, each of said joints having a cup-shaped metal recess, one radiation source element being freely positioned within a respective one of said cup-shaped metal recesses, said irradiator further comprising a plurality of spaced separator rods connecting respective chain pairs at a predetermined spacing. The irradiator preferably comprises a substantially continuous outer wall made from concrete. The second conveyor comprises a lower conveyor section for simultaneously transporting at least two canisters through a lower portion of said irradiation zone and an upper conveyor section for simultaneously transporting at least two canisters through an upper portion of said irradiation zone; and both of the upper and lower conveyor sections comprise roller conveyors.

The present invention is provided for in a second aspect thereof by an assembly for transporting a plurality of product-containing canisters to an irradiation system. The transport assembly comprises a substantially flat truck trailer bed comprising means for supporting said plurality of canisters. At least one guide can be positioned adjacent each of at least two edges of said truck trailer bed for guiding the movement of at least one of said canisters or the rack onto said bed. A support rack comprises means for retaining said plurality of canisters, said rack comprising at least one flange adapted to slide within said truck trailer bed guides, and includes means for releasably securing said rack to said truck trailer bed, as well as means for lifting said rack from said trailer bed.

At least four canisters are used and at least two of said canisters are positioned directly on the surface of said truck trailer bed. The rack comprises a framework in the form of a first substantially horizontal frame member, a second substantially horizontal frame member spaced upwardly from said first horizontal member by a predetermined distance, said predetermined distance being greater than the predetermined height of each of said canisters, with a third substantially horizontal frame member being spaced upwardly from said second substantially horizontal member by a distance which is greater than said canister height. A plurality of substantially vertical frame members connect said first, second and third substantially horizontal members in a spaced relationship, wherein said vertical frame members and said substantially horizontal members comprise a unitary support framework into which said plurality of canisters can be positioned. A plurality of substantially diagonal cross beams have first and second free ends connected to respective vertical and/or horizontal frame members, said cross-beams comprising means for rigidifying said rack.

The securing means can comprise a plurality of hooks attached to the upper surface of said truck trailer bed and a plurality of complementarily configured latches attached to said rack, said hooks and said latches being adapted to be detachably engaged to secure said framework to said truck trailer bed. The lifting means comprises a plurality of eyelets connected to said framework third horizontal member, wherein the eyelets further comprise means for receiving cables to be attached to said eyelets for lifting said framework; the lifting eyes are located along at least a plurality of corners of the top of said framework.

In yet another aspect the present invention provides an irradiation canister adapted to transport products such as food to an irradiator. The canister comprises an upper wall, a lower wall, and opposed first and second sidewalls connecting said upper and lower walls to each other in spaced relationship. First and second removable end plates are detachably connected to respective open first and second ends of said canister. An insulating membrane can be attached to the inner surfaces of said opposed end walls and said upper and lower walls, said insulating membrane comprising means for maintaining a predetermined temperature within said canister; and the canister also includes means for rigidifying four corners of said canister along substantially the entire canister length, said rigidifying means further comprising means for absorbing greater amounts of irradiation than said four walls.

Each of said walls and said end plates are formed from a low gamma-ray absorption material, e.g., aluminum. The canister is preferably 40 feet long, having a width of approximately 32 inches and a height of approximately 32 inches. A plurality of product-containing cartons can be positioned within said canister.

Each of a pair of removable end plates can comprise a gasket adapted to tightly seal said canister, either when said end plates are inserted into said first and second open ends, or when a hinge is used for hinging each of said end plates to said open ends; and the canister can further comprise means for reducing the coefficient of friction of the surface of said lower canister wall along which product-containing cartons are adapted to slide. The means for reducing the coefficient of friction can alternately comprise a plurality of vibrators connected to the lower wall for vibrating said lower wall, or can comprise a thin sheet of slick and rigid material positioned on the upper surface of said lower canister wall.

In still another aspect of the present invention, a system is provided for transporting and irradiating food products positioned in a plurality of irradiation canisters. The system comprises a first building or unloading a plurality of irradiation canisters from truck trailer beds, a second building for housing an irradiator, said second building being spaced from said first building and comprising means for irradiating said plurality of canisters when said canisters are conveyed through said irradiation building. A third building is spaced from said first and second buildings, said third building comprising means for loading irradiated canisters received from said irradiation building onto truck trailer beds; and means are provided for conveying said canisters from said first building to said second building, through said second building over a path along which said canisters are irradiated, and from said second building to said third building. To save space, the first and third buildings can be combined into a single building.

The means for conveying said canisters comprises a first conveyor located below ground for conducting said canisters from said first building to said second building, and a third conveyor located below ground for conveying said irradiated canisters from said second building to said third building. The means for conveying further comprises a second conveyor located within said irradiator building for conducting said canisters along an irradiation path comprising a lower irradiation path portion and a substantially parallel upper irradiation path portion. Each of said truck trailer beds can include means for pushing said plurality of canisters from said beds and into said first building. The system further comprises means for removing a plurality of canisters from said truck trailer beds in pairs (although they can be transported singly) and for conducting said canisters in pairs to said irradiator, through said irradiator, and to said third building. Each of said conveyors preferably comprises a plurality of power-operated rollers for moving said plurality of canisters. The irradiation building comprises first and second elevators for raising and lowering canisters from below ground and to below ground level, respectively, and a main irradiation zone for irradiating canisters conducted through said building; and the second conveyor comprises means for switching the positions of canisters on said conveyor as they are conducted through said building.

The system can further comprise means for cooling the interior of said canisters, which cooling means can comprise a cryogenic system.

In still another aspect of the present invention, a method of irradiating a plurality of product-containing canisters is provided, each of said canisters holding a plurality of product-containing cartons. The method comprises positioning a plurality of carton-holding canisters on a truck trailer bed, transferring said canisters from said trailer bed to a canister irradiator, conducting said canisters through said irradiator to expose said products to irradiation within predetermined maximum and minimum limits, and conducting said canisters from said irradiator to said truck trailer bed.

The canisters are conducted to said irradiator underground with a first conveyor and are thereafter lifted by a first irradiator elevator to the irradiator. The canisters are then conducted along a lower irradiation path portion and an upper irradiation path portion past an irradiation source, thereafter using a second elevator to lower said canisters to an irradiator exit below ground level. The irradiated canisters are then conducted from the irradiator exit to a loading station where said canisters are loaded onto said trailer truck bed. The canisters are irradiated in said building by both vertical and horizontally arranged radiation source plaque sections, each of said canisters having an upper surface, a lower surface and first and second side surfaces, said canisters being conducted in pairs (preferably) along a lower radiation path portion in which said upper surfaces and a first side of each canister are irradiated by said source plaques and along an upper irradiation path portion along which said lower wall and a second side of each canister are irradiated by said source plaque.

In still another aspect, the present invention provides a method of handling a plurality of product-containing cartons in an irradiator, wherein the method comprises positioning said plurality of product-containing cartons in a canister having upper and lower walls, first and second opposed sides, and first and second end caps closing the open ends of said canister, transporting said canisters through an irradiation path within an irradiation building, and unloading said cartons from said canister.

The cartons can be positioned within said canister by hydraulic lifters which lift one open end of said canister above the opposite end of said canister, and thereafter cartons are slowly slid into said canister. The method further comprises reducing the coefficient of friction of the inside lower surface of said canister by vibrating said inside lower surface as said cartons are positioned within said canister.

Individual cartons can be nested within each other and within said canister. The plurality of cartons can also be nested within said canister by stacking the cartons nested assemblies of product-containing cartons, raising said canister with a crane so that the longitudinal axis of said canister is in a substantially vertical position, lowering said canister over said assemblies to enclose said assemblies, and thereafter tipping said filled canister into a horizontal position.

The step of unloading said canister can comprise tipping said filled canister into a substantially vertical position and lifting said canister off of said assemblies. The cartons can alternately be positioned within said canister by pushing a first assembly of cartons into a closed end of said canister and thereafter pushing other assemblies as far into said container as possible into positions adjacent said first assembly of cartons, thereafter repeating said carton assembly pushing with additional cartons until said canister is full. Each canister can be unloaded by pulling on corners of boxes of cartons until the carton-containing boxes are unlatched from each other and removed from said canister; or the canister can be unloaded by opening one end of said canister and pushing on corners of said boxes until said boxes are unlatched from each other and pushed outwardly of said canister. In this case, cartons are loaded into said canisters by positioning said cartons within a substantially parallelepipedic box having a low coefficient of friction and dimensions smaller than the dimensions of said canister, each of said boxes comprising male and female latching members which are adapted to engage each other when two of said boxes are positioned adjacent to each other.

BRIEF DESCRIPTION OF THE DRAWINGS

The above and other objects, features and advantages of the present invention will be discussed more fully hereinafter with respect to the detailed drawings, in which like reference numerals are used to describe similar parts throughout the drawings, and wherein:

FIG. 1 is a plan view of a canister formed in accordance with the present invention;

FIG. 2 is a sectional view taken along line A—A of FIG. 1 illustrating a canister formed in accordance with the present invention;

FIG. 3 is an exploded cross-sectional view of one corner portion of the canister of FIG. 2 illustrating two distinct methods of attachment;

FIG. 7 is a side plan view of a plurality of boxes attached to each other by latching devices;

FIG. 13 is a sectional view of the irradiator of the present invention taken along line D—D of FIG. 9;

FIG. 14 is a sectional view of the irradiator of the present invention taken along line E—E of FIG. 9;

FIGS. 15*a*–15*j* are schematic views of the method of interchanging canisters while transporting them through the irradiator in accordance with the present invention;

FIG. 17 is a plan view of four canisters being irradiated in accordance with the present invention in which the irradiation elements are maintained vertically and horizontally with respect to the plane of motion of the canisters;

FIG. 18 is a top plan view of a chain conveyor in which a plurality of source elements are retained in links of a chain;

FIG. 19 is a perspective view of spacer elements spacing two source retaining chains;

FIG. 20 is a sectional view of the irradiation elements retained in the chain links of FIG. 18;

FIG. 22 is an exploded sectional view of one type of canister end closure;

FIG. 23 is a sectional view of the canister end closure of FIG. 22 after attachment to the canister;

FIG. 24 is a sectional view of a canister shaped in an alternate fashion;

DETAILED DESCRIPTION OF THE DRAWINGS

Figure 4:
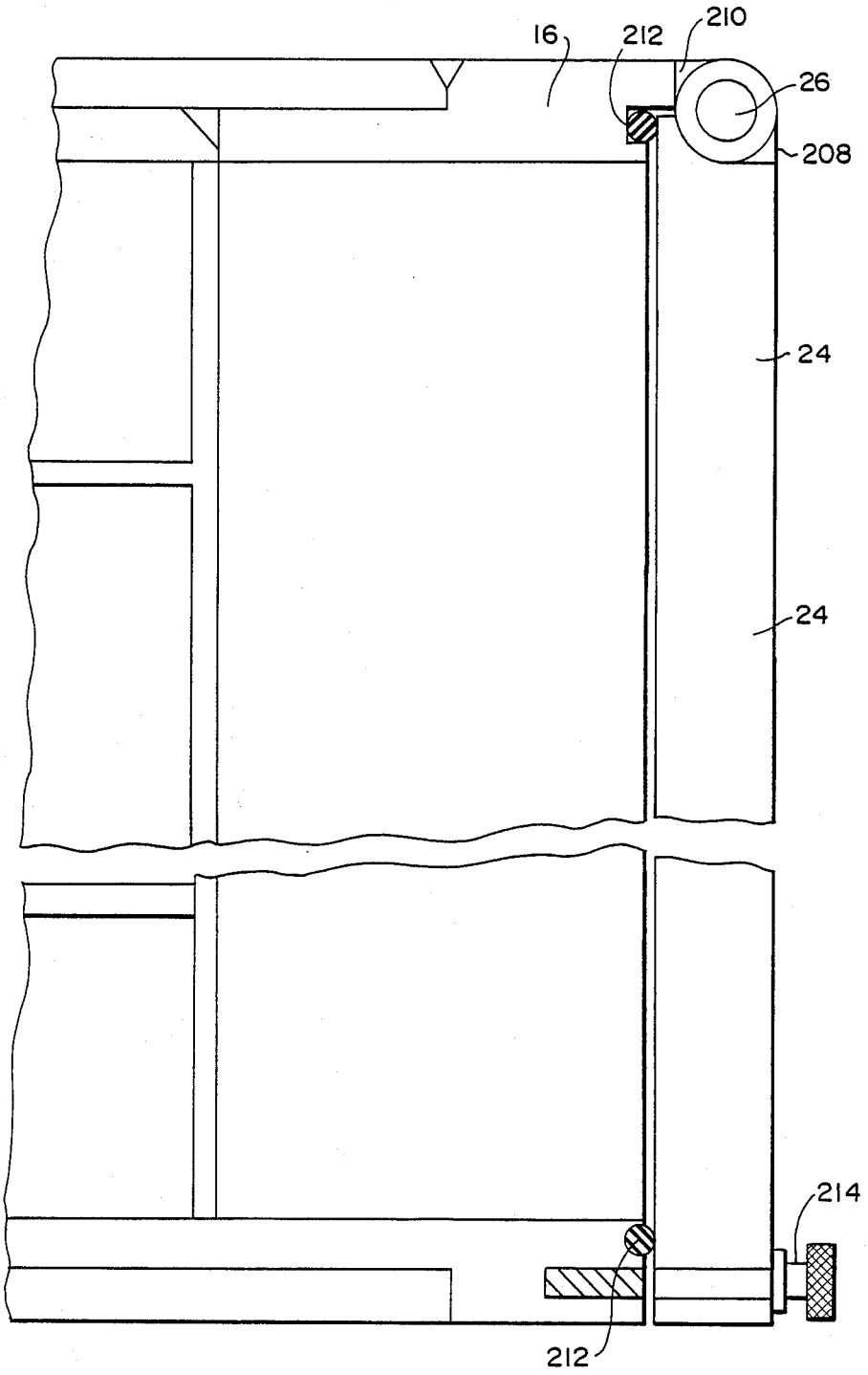
FIG. 4 is a sectional view of a hinged canister end door formed in accordance with the present invention.

With more specific reference to the drawings FIG. 1 illustrates a substantially parallelogram-shaped canister 10 having substantially square first and second ends 12 and 14. Each of the canisters will preferably have a length of approximately 40′ and a cross-section measuring approximately 32″×32″ (outer dimensions). Shorter canisters, e.g., on the order of 20′ in length, may be used, and their cross-sectional areas can be varied in order to accommodate a variety of products and a variety of packing densities of products. The canisters themselves can be constructed of, e.g., aluminum or other materials having low gamma-ray absorption cross-sections. The thickness of the canister walls can be kept within a range of $\frac{1}{4}$″ to $\frac{1}{2}$″ maximum, and may also be provided with a relatively lightweight insulating membrane (not shown) along its interior surface which will form an inner lining for the canisters and which will serve to facilitate the transport of food products which must be maintained below atmospheric or other predetermined temperatures. Corners of each canister are reinforced along the entire canister length, as best illustrated in FIGS. 2 and 3. As shown in FIGS. 2 and 3, the material used to form corners 16 is a relatively thick piece of aluminum or other metal. The integrally connected canister lower, upper and side walls 20 can be attached to corner reinforcements 16 by welds 18, rivets 22, or by a combination thereof (see FIG. 3). Closure systems used to close the open ends of the canisters are provide in a flush fashion with the walls of the canisters to facilitate movement of the canisters through the irradiator, and to eliminate interference with the radioactive source elements.

The canisters preferably have a square cross-section but can also be more generally rectangular in cross-section. The broken lines in FIG. 3 are provided to illustrate two different ways to attach the reinforcing corner structure 16 to walls or plates 20, e.g., by rivets 22 or welds 18. The reinforcing corners preferably extend over the entire length of the canister structure. Alternately, a single extruded aluminum tube (rectangular or square) with reinforced corner sections could be used. Food containing cartons can then be positioned within the canisters, either on pallets, in assembly boxes, or stacked individually in accordance with a predetermined arrangement.

Figure 21:
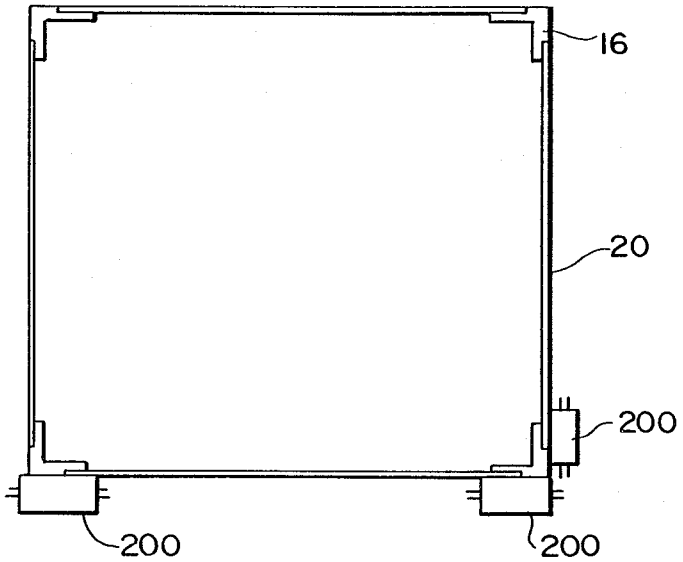
FIG. 21 is a plan view illustrating the interaction between a canister and rollers on a truck bed or rack.
Figure 29:
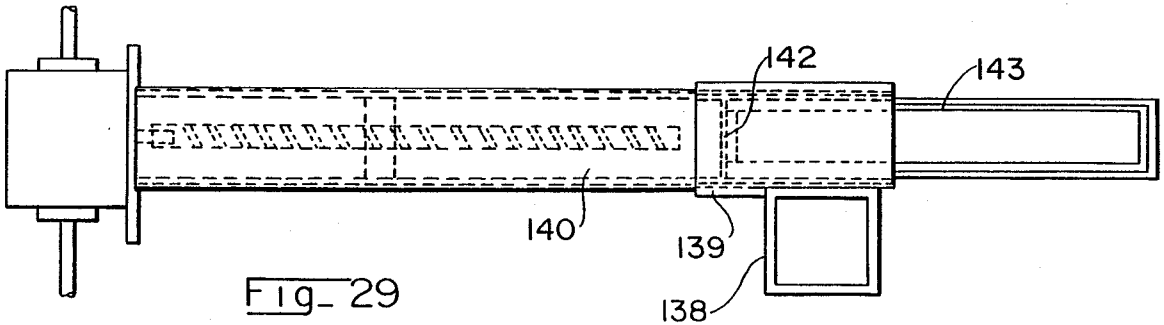
FIG. 29 illustrates, in plan, a device for moving canisters laterally in the canister transposition mechanism.

As shown in FIG. 21, rollers 200 can be provided along the bottom and side walls of a truck rack to facilitate movement of canisters into and out of a truck during the transport and irradiation process.

FIG. 22 illustrates one type of closure 202 used to close the open ends of canister 10. The closure comprises an annular ring section 204 which is approximately equal in thickness to the reinforcing canister corner section. This ring is welded to the canister side walls and corner, as indicated by welds 206 in FIG. 23. After welding, the end closure further strengthens the canister and serves as an additional structural support member.

Preferably, no obstructions exist along the inside of a canister 10 which would prevent the smooth passage of product therein; nor on the exterior to avoid interference with the radiation sources during radiation.

As illustrated in FIG. 4, the end closure plates can alternately comprise hinged end doors 24, hinge 26 being connected to the corner reinforcement 16 by being welded to such reinforcement. These end doors can be pivoted away from the otherwise open ends of the canister to eliminate any obstructions and permit clear and direct passage of material, i.e., cartons and/or boxes holding the cartons, into and out of the canister.

Hinge 26 is welded to closure plate 24 at weld 208 and to corner 16 at weld 210. A sealing gasket, e.g., O-ring 212, is positioned between the cannister end and hinge panel or plate 24. When the plate is closed, e.g., by one or more latching bolts 214 provided on the plate, the O-ring is compressed to provide an adequate seal against leakage of liquid nitrogen or other gases used in the canister. The hinge used can be provided in a substantially conventional manner. The gasket and bolts could also be used with the closure plate of FIG. 22.

As shown in FIG. 24, the canister 10 could be formed with arcuate corners from extruded aluminum or a fiberglass resin; in such case, right angle corners 215 could be provided to facilitate engagement of the canister with rollers on the truck or rack.

Figure 5:
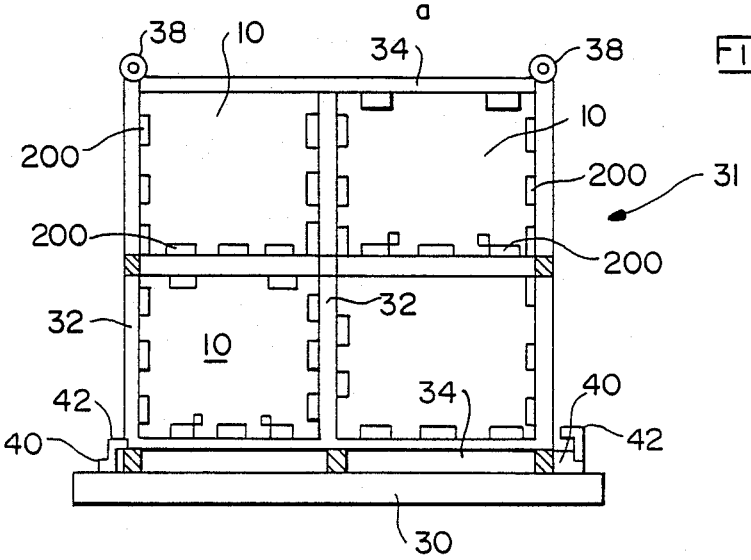
FIG. 5 is a cross-sectional view of a plurality of canisters positioned by hold-down latches on the upper surface of a truck transfer bed.

As illustrated in FIG. 5, it is expected that four or more canisters 10 can be positioned on the upper surface of a trailer bed 30 to produce a total net load of approximately 40,000 pounds. This number has been selected because it is within regulatory limits of gross weights allowed for highway travel; although it is possible to design a system capable of handling even larger weight allowances within food product canisters, because these canisters are quite beneficial in comparison to commonly used trailer vans and because they do not include the dead weight of the trailer body and undercarriage of conventional trucks.

The canisters of FIGS. 1–4 are intended to accommodate at least 15 different types of produce which have been approved for irradiation disinfestation. Using standard carton sizes, the cartons can be arranged either on pallets positioned within the canisters or loosely stacked to efficiently fill one canister.

Figure 6:
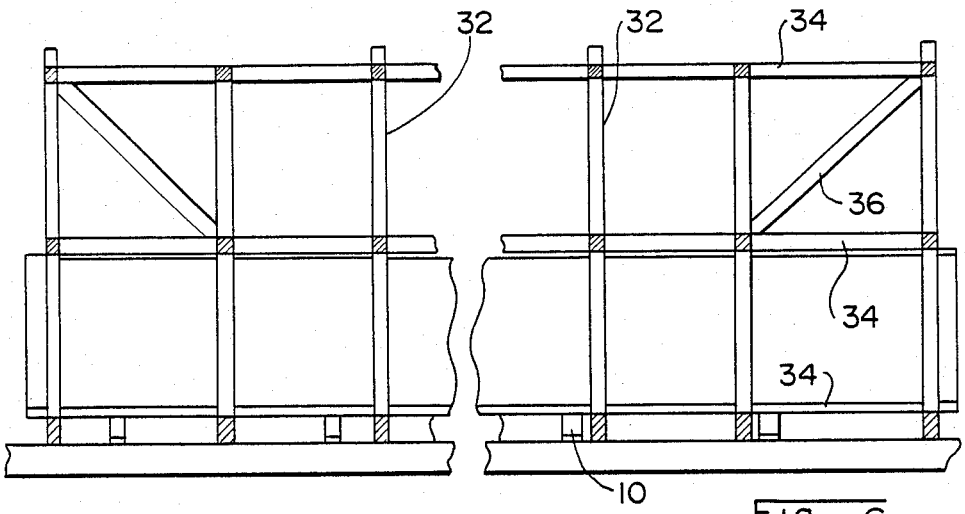
FIG. 6 is a side plan view of the rack and the hold-down latches of FIG. 5.

As illustrated in FIGS. 5–7, a rack 31 is provided for retaining a plurality of canisters on truck trailer bed 30. Specifically, rack 31 is provided having a plurality of generally vertical frame members 32 and a plurality of substantially horizontal frame members 34. The canisters 10 are positioned on each of the substantially horizontal frame members 34 With hinged doors 24 provided to open outwardly between the openings in the framework. If necessary, diagonal bracing members 36 (see FIG. 6) can be provided to further support the framework, particularly when more than four canisters are positioned within the framework. At the corners and at other upper portions where the vertical and horizontal members intersect, a plurality of lifting eyelets 38 can be provided to assist in removing the entire rack from a flat truck trailer bed. Eyelets 38 are best illustrated in FIG. 5. Further, a plurality of hold-down latches 40 can be provided which are formed integrally with the upper surface of the truck trailer bed. Hold-down latches 40 include flange portions 42 (see FIG. 5) which are adapted to overlie respective hooks on bottom rack member 34. The hold-down latches retain the entire rack and canister assembly on the upper surface of truck trailer bed 30. Other conventional attachment devices, e.g., bolts or clamps, could be used to detachably connect the rack to a truck bed base. The particular latches selected should provide for easily disconnecting the rack from a truckbed, and need to be strong enough to support stresses placed on the frame as a result of the dead load carried and dynamic loads resulting from vehicle motion.

Rollers 200 can be provided along both horizontal and vertical rack surfaces to facilitate sliding motion of the canisters within the racks.

The vertical members 32 and horizontal rack members 34 serve to confine individual canisters 10 and limit vertical and horizontal motion thereof. Because rollers 200 are provided, however, it is possible for the canisters to move unintentionally as a result of sudden vehicle deceleration or acceleration. Consequently, additional (and conventional) restraining members may be necessary along the front and rear rack ends. These members can comprise additional cross-braces 36 (see FIG. 6) or, e.g., hydraulic cylinders (not shown) having shafts to move locking members which cover the canister ends.

Canisters 10 are adapted to be first utilized at the point at which produce is packaged so that conveyors coming off of the packing line can be used to automatically package cartoned products onto pallets or so that the cartons can be loaded directly into a canister. To facilitate such canister loading, each canister will be sufficiently rigid to permit it to be moved directly hydraulically or otherwise from its location on the trailer bed and outwardly onto a loading dock where it will be efficiently packaged within the canister. Alternately, the trailer truck can be located at a loading dock and conventional transport equipment can be used to move cartons directly from the packing line into canisters as the canisters remain in position on the trailer bed. Once the canisters have been loaded in either of the above fashions, the pivoting ends of the canisters are closed and the canisters are appropriately cooled, either by cryogenic systems located on the trailer bed or by conventional refrigeration systems. In this way, produce is placed into a proper temperature condition for eventual transport to the marketplace.

When canisters 10 are used, the interior of the canisters, i.e., the environmental atmosphere within the canisters, can be changed in order to retard or accelerate the ripening of food within the canisters. Nitrogen or a mixture of other gases can be placed within the canister. Since the canisters act as sealed chambers, these canisters can be used to alter the ripening conditions in a predetermined manner to accommodate different growers, shippers, or produce to be shipped.

The irradiator is then designed to accommodate the canisters so that as the product is carried through the irradiator, a predetermined maximum and minimum dosage range as required by government regulations and customer needs will be achieved. It is important to remember that loading cartons of produce or other food products into a canister must satisfy a plurality of minimal criteria. For example, the cartons cannot be subjected to undue pressures or loads which would crush or otherwise damage food products contained within the cartons, and it is important that the cartons be arranged within the canisters so as to fill the cross-sectional area of the canister and so as to prevent large air gaps from being created between the product cartons and the inner walls of the canister.

It is contemplated that within the present invention there will be a variety of methods of both loading and unloading cartons into canisters. Although all of these various methods are not illustrated in the drawings, it is clear that the types of apparatus used are well within the skill of those of ordinary skill in the art.

Hydraulic lifters constitute one example of carton loading and unloading apparatus which could be used. The lifters would be used while canisters remained in the truck bed frame to lift the open door at one end of the canisters above the opposite end of the canisters and to then utilize gravity to slowly slide pallets of cartoned products into the canisters. To facilitate such loading, means, e.g., a non-slip surface, are provided to reduce the coefficient of friction of the lower interior surface of each canister. The sliding motion can be more easily accomplished, e.g., by providing vibrators which vibrate the lower surface of the canisters.

Alternately, individual cartons can be nested so as to completely fill the inside cross-sectional area of the canister by using automatic carton conveyors and handlers. Using this method, at appropriate intervals, cardboard or hardboard separators would be positioned between groups of cartons, and the carton assemblies would be automatically and circumferentially taped to permit movement of a group of cartons together into and out of the canister. An assembly of cartons which fills the cross-sectional area of the canister can thus be automatically placed together onto a relatively thin, slick sheet of rigid material having a low coefficient of friction. In this fashion, the entire assembly, including the low coefficient of friction sheet of material, can be pushed into the canister one assembly at a time. The pushing can be accomplished by a piston driven apparatus, in which the piston stroke will be shortened with each successive assembly which is being slid into the canister. The loading and unloading of the canister can be facilitated by tilting the canister to an appropriate degree.

When the strength of the cartons is sufficiently high, pallets or slip skids comprising a nested assembly of cartons can be stacked upon each other up to a 20′ height. Such stacking requires the use of an enclosing fixture, e.g., a rack, to hold the carton stacks erect. When an internal rack is used, each canister can be lifted by a crane and the canister will be held in a position in which its longitudinal axis is in a substantially vertical position. Each canister can then be lowered over and enclose a stack of carton assemblies, and the filled canister can then be tipped over horizontally and transported to a truck. After irradiating and transporting the enclosed product, a substantially reverse method can be used to unload cartons from the canister. Specifically, the canister is lifted, leaving a stack of carton assemblies on the ground. In this arrangement, a box framework comprising four corner angled pieces can be used with cross members, as best illustrated in FIG. 7, to support the stacking load of the assemblies and reduce load on the lower cartons. The increased gamma-ray absorptive materials in the corners of each canister, i.e., reinforcement zones 16, will be tolerated because four-sided irradiation tends to normally produce high dose levels in the corners. The use of the reinforcing angles 16 will therefore help to keep the maximum to minimum dose ratio down to acceptable limits.

By using an internal framework having angles within its corners, assemblies with cartons which fill the cross-section of the canister can be pushed into the canister. Thin sheets of nylon can be attached to the lower surface of the angles to provide low coefficient of friction contact surfaces during sliding of the framework onto the surface of the lower wall of each canister. Similarly, the framework unit can be easily removed from the canister for unloading individual canisters; this type of system can be used to load and unload canisters which are up to 40′ in length while they are still positioned on the truck bed.

Alternately, other arrangements can be provided in which the carton assembly is smaller in cross-section than the inside cross-section of the canister. As one example, relatively long, thin conveyor systems can be inserted into each canister to permit pallets of cartons to be loaded into the canister, the conveyor being adapted to be gradually withdrawn from each canister as each canister is loaded. Unloading would require the use of one of the processes noted above because the conveyor could not be inserted into each canister while product remains in each canister.

In FIG. 7, a plurality of smaller-dimensioned boxes are adapted to retain a plurality of cartons in a nested fashion which fill the boxes. Each box-like unit is formed from aluminum or a radiation resistant plastic having a low coefficient of friction. The top of each box does not prevent automatic loading of cartons in a nested assembly to fill the box, i.e., it is open. As best seen in FIG. 7, each box 42 has a generally square outer frame with walls 44, 46, 48 and 50 and can include, e.g., supporting cross members or braces 52 and 54 at one end thereof. The top of each of these boxes is fully open. To rigidify the box, if necessary, a flat sheet of aluminum or plastic can be placed along one or both sides perpendicular to the axis of the canister.

In operation, when using these boxes, a single box is automatically loaded with cartons and the box is pushed at its four corners into the canister. The first box is pushed into a far opposite end of the canister which is closed. The next box is then loaded and is thereafter pushed into the canister to a point where conventional latches, e.g., mating male and female members or tongue and groove assemblies 56 and 58 on the boxes are used to engage the first two boxes in a closely adjacent position within the canister. This pushing/loading system continues until the canister is loaded. Such loading can be achieved when the canister is on the truck bed or when the canister is removed from the truck bed prior to being positioned on the truck bed for box or carton loading. During unloading, the corners of each box can be pulled and each box unlatched as it is removed from the canister, or the door at the other end of the canister can be opened and the boxes can be pushed outwardly from the other, open end of the canister.

After irradiation, the canisters are hydraulically locked back into place on the upper surface of the trailer bed. Each canister can have runners on the bottom thereof (unillustrated) which permit each canister to be guided and moved onto or off of the trailer bed. In one embodiment, e.g., four canisters are positioned within a rack system, as best illustrated in FIGS. 5 and 6; rack 31 provides structural rigidity to the entire trailer unit and serves to minimize the number of structural beams required on the undercarriage of the trailer.

The canisters, when nested into the structural framework on a trailer bed, as illustrated in FIGS. 5 and 6, can be treated as a single removable unit similar to containers currently used in shipboard and rail loadings. Thus, the canisters can be designed with nesting or stacking male and female areas (not illustrated) which will better accommodate stacking, as in present shipbound containers. If such an arrangement were used, latching mechanisms would be provided to releasably connect the entire nested canister system or rig from the trailer bed. Such a system can include, e.g., appropriate hasps or eyelets 38 at the corners of the nested canister system and at midposition thereof; these hasps would permit the attachment of cables to the system, which could be used together with shipboard loading cranes to raise and lower the canister assemblies to and from the truck trailer.

Figure 8:
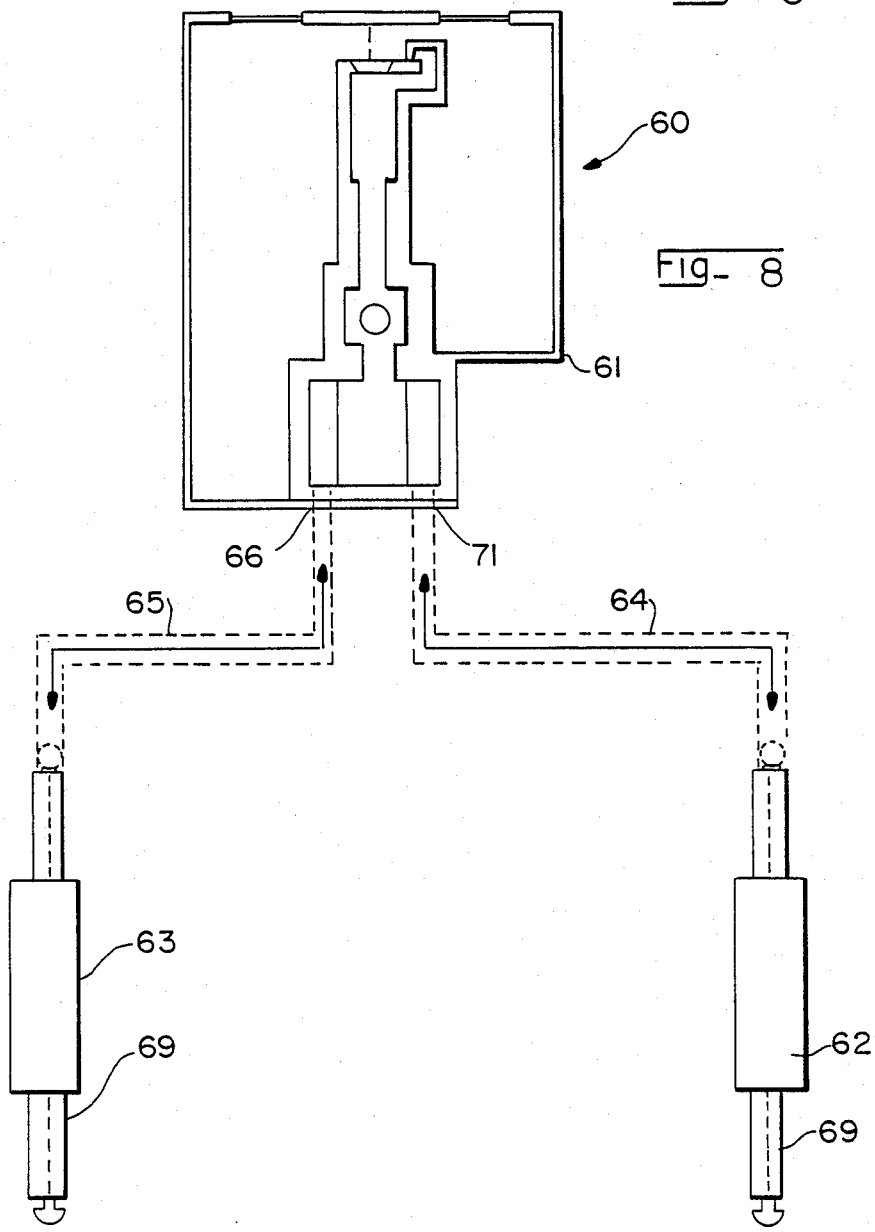
FIG. 8 is a top schematic plan view of a floor lay-out of transfer and irradiator buildings used to irradiate canisters formed in accordance with FIGS. 1–7.

In operation, a fully loaded truck trailer comprising four canisters would approach an unloading building where each canister would be taken off of the truck and slid directly onto a conveyor system which will move entire canisters, preferably in pairs, to an irradiator unit 60. FIG. 8 is a schematic illustration of an irradiator system 60 used in conjunction with the canisters of the present invention. FIG. 8 is a floor plan layout of an irradiator building, and its accompanying out-buildings, for processing canisters as described above. The irradiator system comprises a main irradiation building 61, an unloading building 62, and a loading building 63. The out-buildings, i.e., unloading and loading buildings 62 and 63, are spaced from the irradiator building by a distance sufficient to permit easy maneuvering of trucks in and around the buildings. The primary purpose of the out-buildings is to facilitate transfer of canisters to and from the trailer truck prior to, and after, irradiation. If desired, buildings 62 and 63 can be combined into a single out-building structure.

In operation, a trailer truck backs up to unloading building 62, and canisters within the truck are aligned with appropriate conveyors, e.g., conventional belt, rollers, or chain-driven conveyors, located within building 62. Canisters are unlatched from the trailer bed and advanced by a power take-off located on the trailer bed, e.g., a piston driven pushing mechanism. Each canister is thus moved directly into and onto a roller conveyor system. Entrance to the conveyor system can be achieved from either end of the unloading building, particularly if the conveyors were provided on the trucks or if multiple conveyors were located in building 62. In this fashion, one trailer truck 69 can be unloaded while another is moved into position to prepare for loading or unloading.

There are basically two alternate approaches to loading and unloading canisters from a truck. One approach is to use an on-truck conveyor utilizing power taken from a truck tractor; and the other is to provide a minimum amount of equipment on the trailer and to associate a canister conveyor/loader/unloader with buildings 62 and 63. As one example of the latter system, an extensible conveyor could be pushed onto the truck from the building, thereafter lifting one or more canisters and withdrawing them from the building. Use of an on-truck conveyor would be disadvantageous in view of increased initial expense for the system; but could be advantageous insofar as it would permit two trucks to simultaneously load and unload at a single building.

In one embodiment now contemplated, during unloading, a truck moves into place against a dock of building 62. A conveyor unit 166 associated with the building (if such embodiment is used) is extended onto the truck bed, with relative motion provided by the conveyor rollers 168. When the conveyor's motion terminates, short hydraulic cylinders or other conventional lifting apparatus can be used to raise the conveyor, engage the lower canister surfaces, and lift the canisters so as to clear the truck bed. The extension conveyor is then withdrawn with the canisters, and both are placed on the building elevator. The elevator is lowered to a level where the canisters can be placed directly on conveyor 64, whose rollers will advance the canisters to the irradiator. The elevator is then raised, with the extension conveyor, in order to repeat these operations.

Figure 16:
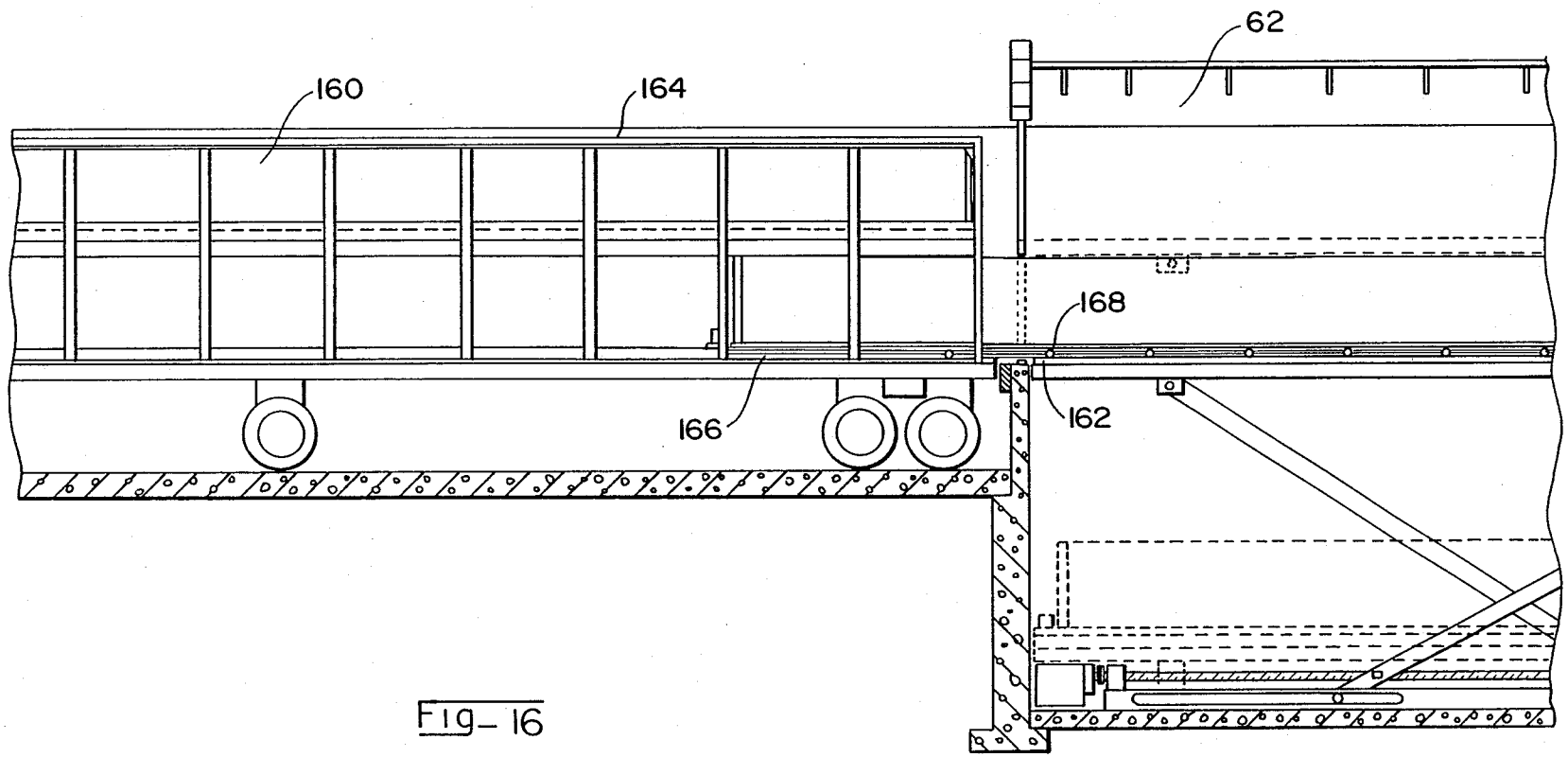
FIG. 16 is a side view of a truck loading canisters at a loading building forming part of the irradiation system.

FIG. 16 represents one embodiment of an unloading building 62. This building itself comprises the canister conveyor structure (rather than having such an assembly on the truck), and thus only one truck at a time can deliver or unload therefrom. Truck 160 is shown as positioned at loading dock 162. The truck has a steel rack or framework 164 located thereon, retaining a plurality of canisters 10. A space or channel is provided between the lower surfaces of the canisters and the truck bed, which permits moveable conveyor 166 to extend under the canisters. A frame is provided for conveyor rollers 168. The conveyor is actuated by a motor/drive screw combination (not shown) to raise the frame and rollers and lift a canister. Another drive unit comprising a motor and screw assembly (also not shown) can be used to move the conveyor drive rollers longitudinally. The particular mechanisms used to move the conveyor are conventional and do not form part of the present invention; further, side-by-side parallel conveyors can be used in order to simultaneously remove side-by-side canisters if desired. The elevator has a platform which is large enough to support both canisters.

After the canisters have been fully unloaded from the trailer bed onto roller conveyor 62 within the unloading building, the canisters are then lowered by an elevator system to a level below ground which is aligned with a first conveyor 64 which moves canisters from the unloading building underground directly to the irradiation building 61. This is performed by power operated rollers or other conventional conveying apparatus. Alternately, freely rotatable rollers could be used, with the canisters movable by, e.g., chains, cables, or hydraulic cylinders. In this fashion, pairs of canisters can be moved simultaneously and together from the unloading building to the irradiation building. The elevator can be of conventional construction such as a scissors lift, a hydraulic cylinder lift, a cable and pulley system, or a mechanical lift.

Successive pairs of canisters are lowered by this elevator to a roller conveyor 64, which conveys the canister pairs to port 71 of irradiator building 61. Each pair of successive canisters is released from roller conveyor 64, where they are then raised to an elevation, by a first irradiator elevator, which occurs after the canisters have entered the irradiation building. A similar conveyor mechanism 65 is used to discharge fully irradiated canisters from exit 66 of irradiator building 61 to loading building 63. During irradiation, therefore, a tractor-trailer operator will have sufficient time to move tractor-trailer 69 into line with one loading dock of loading building 63. Therefore, when canisters have been transported through the irradiator building back to the loading building, they will be paired and oriented properly for reloading onto the trailer bed. Roller conveyors in the loading building (not referenced) are elevated to the proper level for transfer to the trailer bed in the same manner that the unloading conveyors of unloading building 62 were raised to the appropriate level to unload canisters from unloading truck 69.

Figure 25:
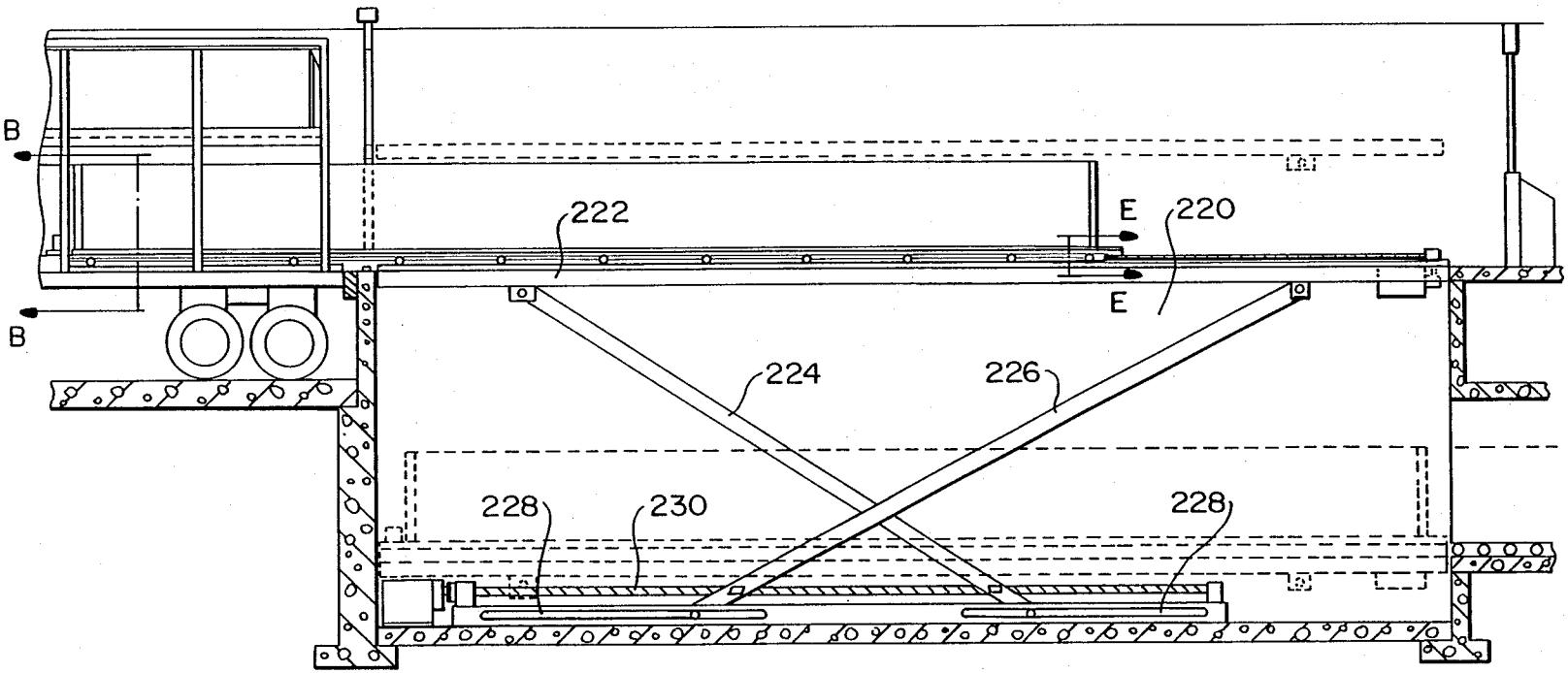
FIG. 25 is a sectional view of a scissor-lift canister elevator formed in accordance with the present system.

First conveyor 64 preferably comprises a powered roller conveyor located within a tunnel connecting the lower level of building 62 to the lower level entrance of building 61. The canisters are moved to conveyor 64 by a conventional freight elevator apparatus, e.g., a scissor type lift device or a piston-driven hydraulic elevator. One scissor type elevator device 220 is illustrated in FIG. 25, and comprises one or more lift platforms 222, scissors 224 and 226, and slots 228 within which ends of the scissors are guided in a generally horizontal fashion. The scissor arm are driven by a motor driven screw 230. The scissor arms could alternately have a crisscross configuration.

Figure 9:
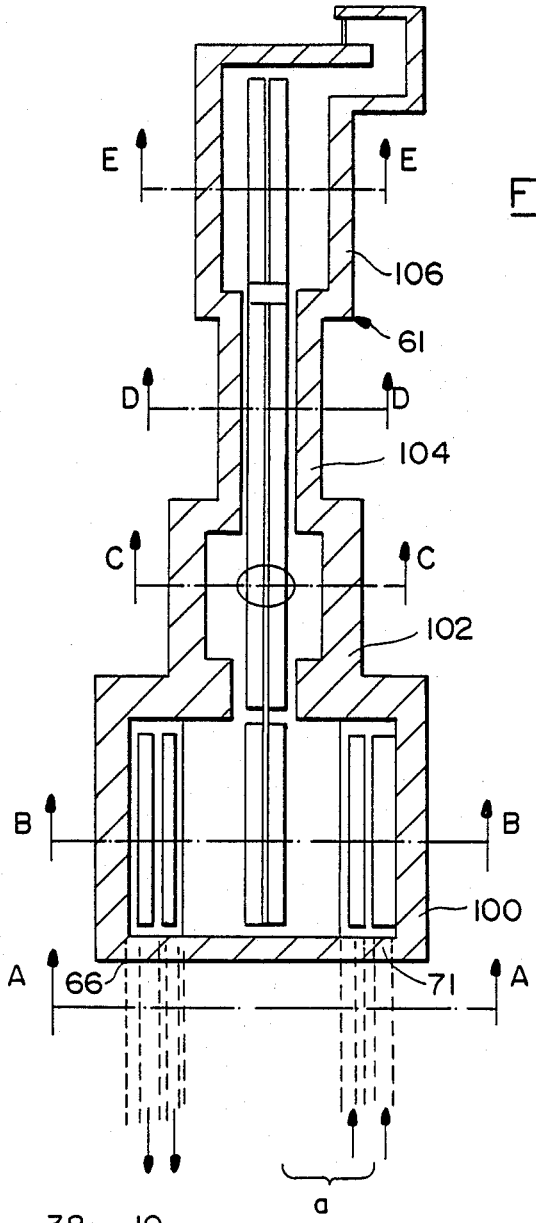
FIG. 9 is a top plan view of the irradiator of FIG. 8.

Irradiator building 61 of the present invention is best illustrated in FIG. 9. A pair of canisters are delivered underground to the irradiator building in alignment to be moved through the irradiation area. The canisters are brought into the building in a position off of the center line of the building by a predetermined distance in order to permit appropriate concrete shielding to be placed in position so as to minimize radiation streaming to the exterior of the building. In other words, as best illustrated in FIG. 9, a labyrinth is formed in building 61 by the path over which each canister is transported. The canisters are conducted by first conveyor 64 below grade to irradiator building 61, and therefore the canisters must be elevated up above floor level, where they are then moved horizontally to a point where they line up directly in line with the irradiation area of the source storage pool. The offset distance is best illustrated by offset distance (a) which is shown in FIG. 9.

After entering through port 71 of building 61, the canisters are positioned by a conventional transport mechanism onto an irradiator elevator 72. This elevator is similar in construction to the elevator used at the loading and unloading building, and it serves to lift a pair of canisters to the floor level of radiation building 61.

Gamma radiation from the radiation source must stream downwardly from the path where canisters are conveyed to and from radioactive source material. The outer walls at the end of the path comprise heavy concrete shielding in order to prevent the escape of direct radiation from the source. Radiation scattered from this position will be at right angles to the direction of motion of the canisters through the irradiation area; radiation must then again scatter downwardly into the tunnel used to convey the canisters. It then must further scatter downwardly throughout the tunnel before it arrives at either of the unloading or loading buildings. Use of this type of a transfer system permits the facility to be designed with relatively low amounts of concrete shielding material yet achieve a desired shielding efficiency.

Figure 10:
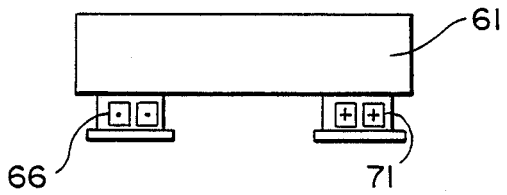
FIG. 10 is a sectional view of the irradiator taken along line A—A of FIG. 9.
Figure 11:
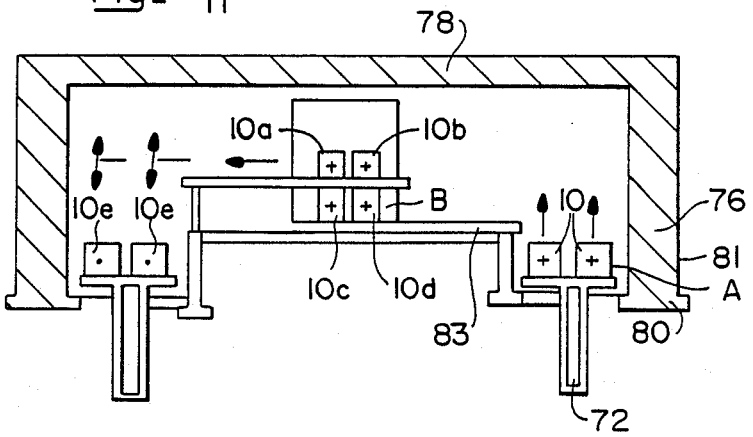
FIG. 11 is a sectional view of the irradiator of the present invention taken along line B—B of FIG. 9.

The motion of canisters through the system from their entry through below-level entrance port 71 into radiation building 61 (as in FIG. 10) will now be described. To facilitate consideration, the rear ends of the canisters, as viewed in their direction of travel, are marked by a +, with the front ends marked by a dot. A pair of side-by-side canisters 10 first move forwardly into position A as illustrated in FIG. 11, in which canisters 10 are positioned below the level of the radiation source. They are thereafter lifted by a substantially conventional elevator mechanism 72 (shown schematically in FIG. 11), and are thereafter transferred horizontally into position B by a conventional conveyor, e.g., a roller or belt conveyor, into the position shown by canisters 10*c* and 10*d* in FIG. 11.

Figure 12:
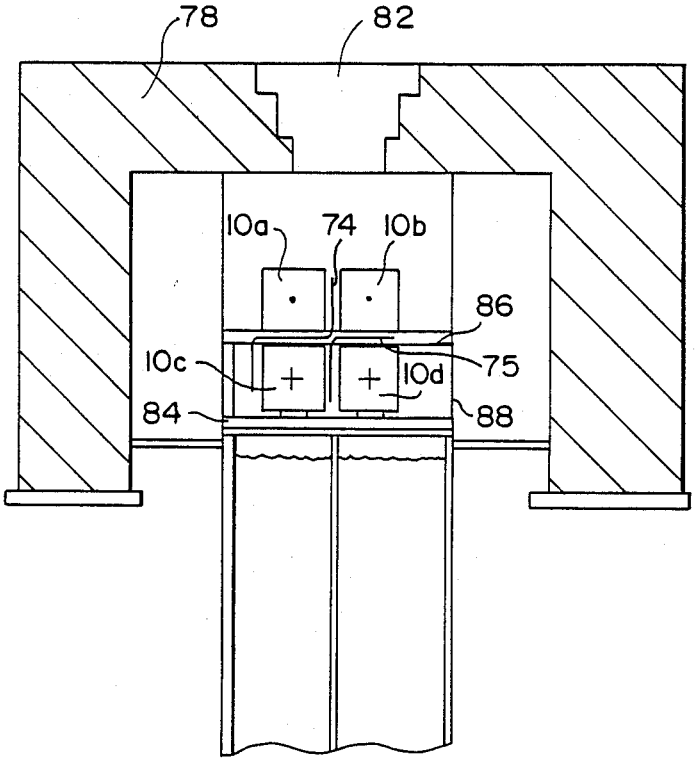
FIG. 12 is a sectional view of the irradiator of the present invention taken along line C—C of FIG. 9.

The canisters are then moved into the irradiation zone, past the irradiation source and then, beyond the irradiation pool, where the canisters are elevated to a second level and are interchanged or transposed. This is best illustrated in FIG. 12, which illustrates canisters 10*c* and 10*d* being moved into the radiation zone while canisters 10*a* and 10*b* are being conducted along a second, elevated level among source plaques 74 and 75. Source plaques are well known within the industry, and comprise a plurality of substantially parallel radiation sources held in a rack or similar structure in a substantially stable vertical and/or horizontal position. An enlarged view of the canisters of FIG. 12 is shown in FIG. 26.

Figure 26:
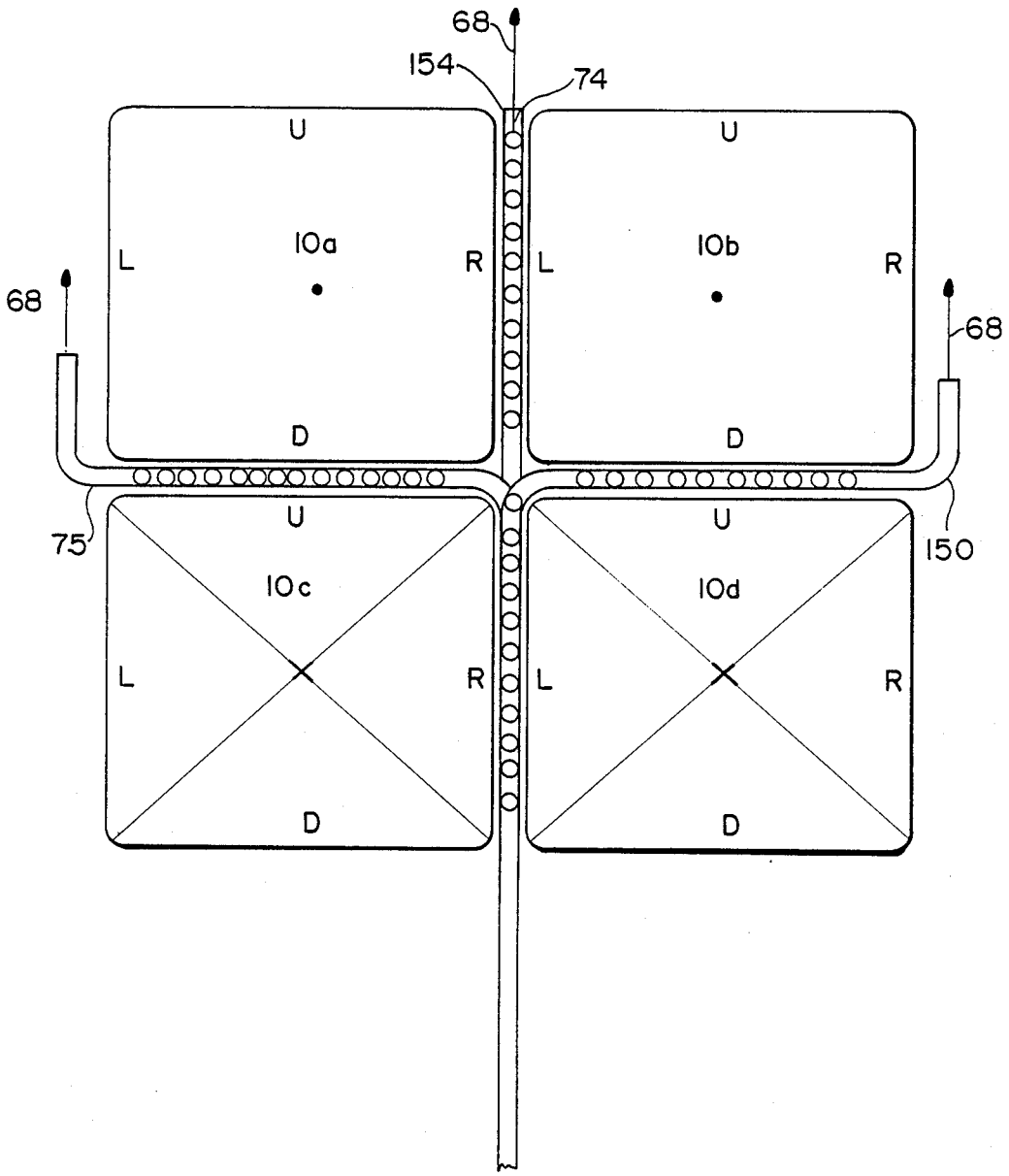
FIG. 26 is an enlarged view of the two pairs of canisters of FIG. 12, which canister pairs are moving in opposite directions.
Figure 27:
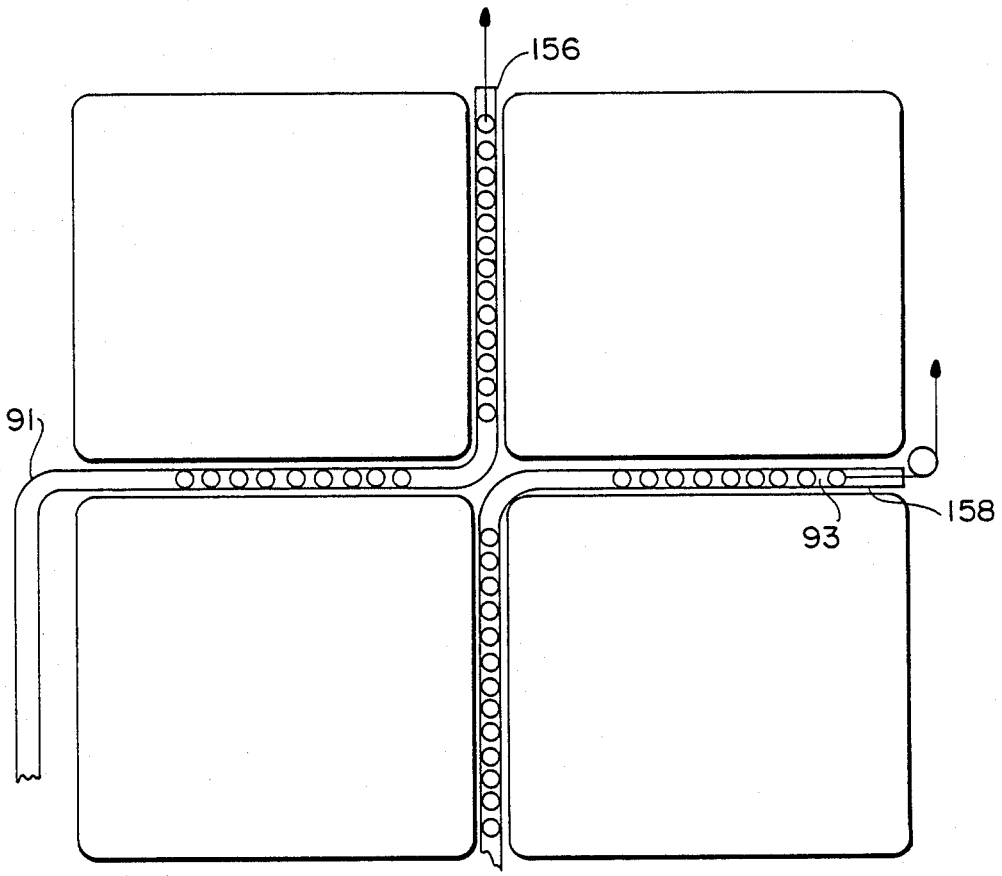
FIG. 27 is an enlarged view similar to that of FIG. 26, having only two source plaque tracks rather than three tracks.

The enlargement in FIG. 26 well illustrates simultaneous irradiation of the bottom and left side of canister 10*b*, the bottom and right side of canister 10*a*, the top and left side of canister 10*d*, and the top and right side of canister 10*c*. Source plaques 74, 75 and 76 are positioned vertically and horizontally between the canisters, and are moved by respective lifting cables 68. There can be up to four source plaques moved along up to four tracks, with three plaques and three tracks 150, 152 and 154 illustrated in FIG. 26, and two tracks 156 and 158 illustrated in FIG. 27.

Canisters 10 then travel in the reverse direction from which they first came at an elevation directly above the position that the canisters occupied during their first pass past the radioactive source material. Although the first path of travel of the canisters through building 61 is shown to be below the second path, it could equally well be the reverse. Upon completion of the travel of the canisters in the source area, the canisters will reach a position adjacent to (and above) the initial position that they were in when they first entered the line of motion advancing them to the irradiation area. At this time, they are transferred at right angles laterally and then downwardly in precisely the same manner that they were transferred when they first entered the irradiation building, i.e., towards exit 66. The irradiated canisters are then conducted outwardly from building 61 through a tunnel by conveyor 65 which carries the canisters to loading building 63.

The building comprises, as seen in FIG. 9, loading and unloading zone 100 and zones 102, 104 and 106. As illustrated in FIG. 10, canisters 10 enter the building 71 via entrance port 67 and exit via exit port 66; both of these ports are underground. Thereafter, the first pair of canisters 10 are lifted upwardly by first elevator 72 adjacent one sidewall 76 of the building. The building comprises opposed sidewalls 76, opposed end walls (unreferenced), a concrete top wall 78, and footings 80 which are designed to anchor the bottom of walls 76 under ground 81. A removable concrete shielding plug 82 is provided to permit entry of source material into the radiation source area. As seen in FIG. 11, new canisters are adapted to be raised by elevator 72 to the level of conveyor 83, and are then conducted by roller or belt conveyor 83 into the position illustrated by canisters 10*c* and 10*d*, and are thereafter conducted by a transverse section of conveyor 83 in a direction represented by the direction of all of the arrows in FIG. 9. Canisters 10*a* and 10*b* represent two canisters at the end of their traverse of the radiation sources, and canisters 10*e* represent canisters which have completed their travel path through building 61 and are about to exit the building via exit 66.

As shown in FIG. 12, irradiator building section 102 is illustrated in which two source plaques 74 and 75 are provided and in which roller conveyor and support framework 84 (lower roller support), upper horizontal framework 86 (upper roller support), and vertical supports 88 are illustrated as supporting two pairs of canisters 10*a*, 10*b*, and 10*c*, 10*d* traversing chamber 102. A removable concrete plug 82 is provided, as indicated above, to receive replenishing radioactive source materials.

FIG. 13 illustrates irradiator section 104, in which the canisters remain on the conveyor systems; and FIG. 14 schematically illustrates a transposing mechanism 110 for elevating the canisters upon completion of a lower traverse of building 61, for raising the canisters into a position in which they are ready to move in a direction opposite from their first traversing path, and transposing them prior to any such movement.

The reorienting mechanism 110 is used to transpose each of the canisters in each canister pair; as a result, two different walls of each canister will be irradiated during each of the two canister traversals of the radiation source, resulting in a uniform radiation dose to all four canister walls. Although one preferred reorienting mechanism is presently contemplated, others could equally well be used. Lateral canister motion can be achieved by using hydraulic or pneumatic cylinders, or motor driven gear and ratchet combinations.

Figures 15A, 15B, 15C, 15D, 15E, 15F, 15G:
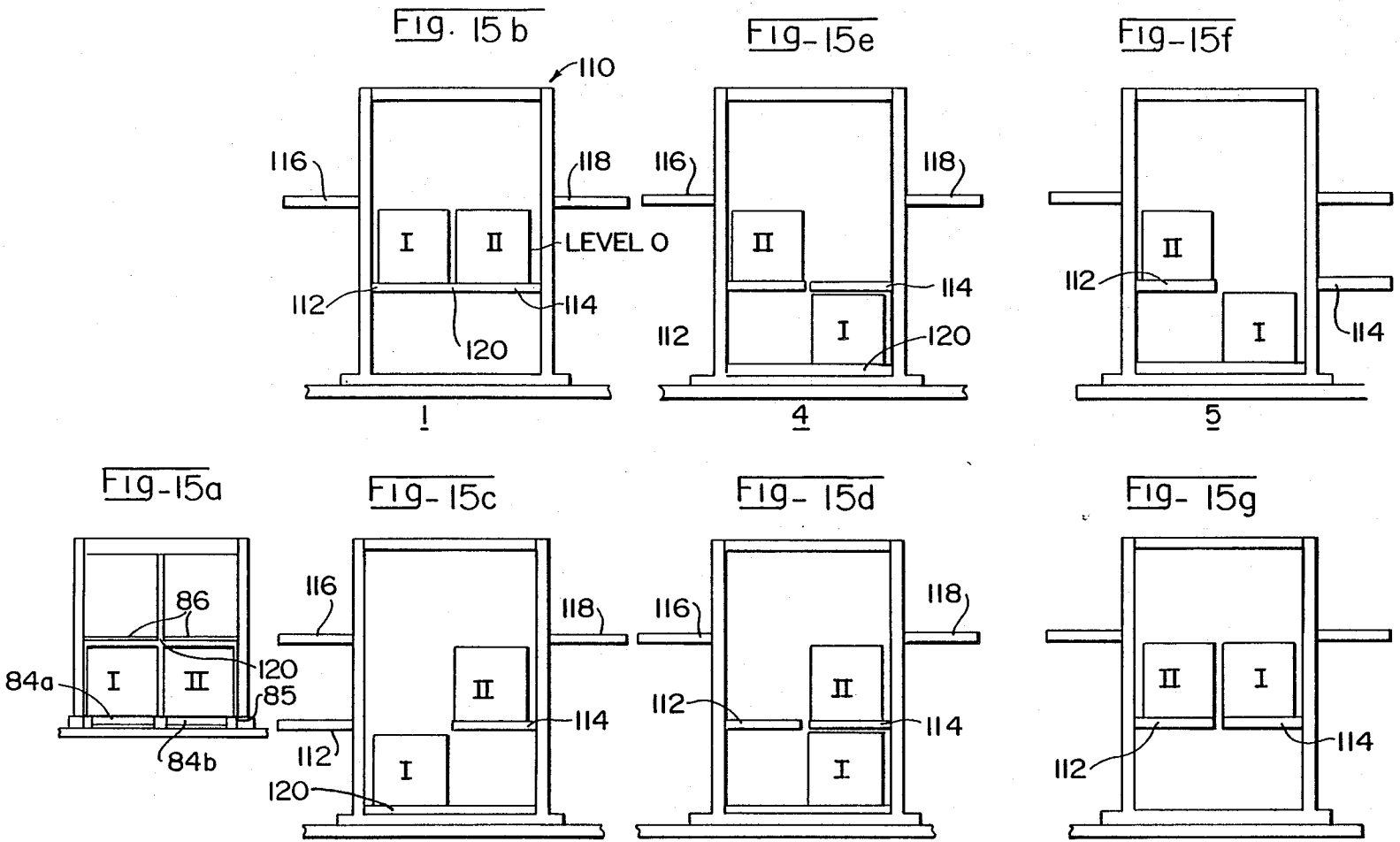

FIGS. 15*a–j* illustrate the overall movement of the canisters as they are elevated and transposed between the lower and upper second conveyor sections. A first pair of containers I, II enter the irradiation building, are lowered 35 onto rollers, and are then conducted along a first path along a lower portion of the building, as shown in FIG. 15*a*. Here they are being conveyed by rollers 84*a* and 84*b*, mounted on a conveyor frame 85. Thereafter, the two canisters are raised to an upper level, where they are conducted through stations 106, 104, 102 and 100 by upper roller conveyor 86.

The rollers in conveyor 86 are small in diameter, i.e., about one inch, to minimize the air gaps/spacing between the upper and lower canister pairs.

Canisters I and II are initially raised to level O, as indicated in FIG. 15*b*, where they are positioned on support arms 112 and 114 and transverse support arm 120. Support arms 116 and 118 are located above arms 112 and 114, and can be moved horizontally into and out of member 110. Support arm 112 is first retracted, as shown in in FIG. 15*c*, and canister I is then lowered and supported by support 120. As shown in FIG. 15*d*, canister I is then moved into the right hand position by a conventional roller conveyor. Support arm 112 is then moved back into its initial position, and canister II is then moved leftwardly by conventional rollers, as shown in FIG. 15*e*, where it rests on arm 112. Arm 114 is then retracted, as in FIG. 15*f*, and canister I is then elevated into the FIG. 15*g* position by transverse arm 120, which then supports canister II with arm 112 and canister I together with arm 114. Both canisters are then elevated further by arm 120, as shown in FIG. 15*h*, where they will soon be supported by arms 116 and 118, which will be pulled back into the frame as shown in FIG. 15*i*, allowing arm 120 to move back to its FIG. 15*b* position. Two new canisters III and IV are then inserted in transposer mechanism 110, as shown in FIG. 15*j*, and the transposition of canisters III and IV begins as canisters I and II leave mechanism 110 and traverse the upper portion of the second conveyor.

Figure 28:
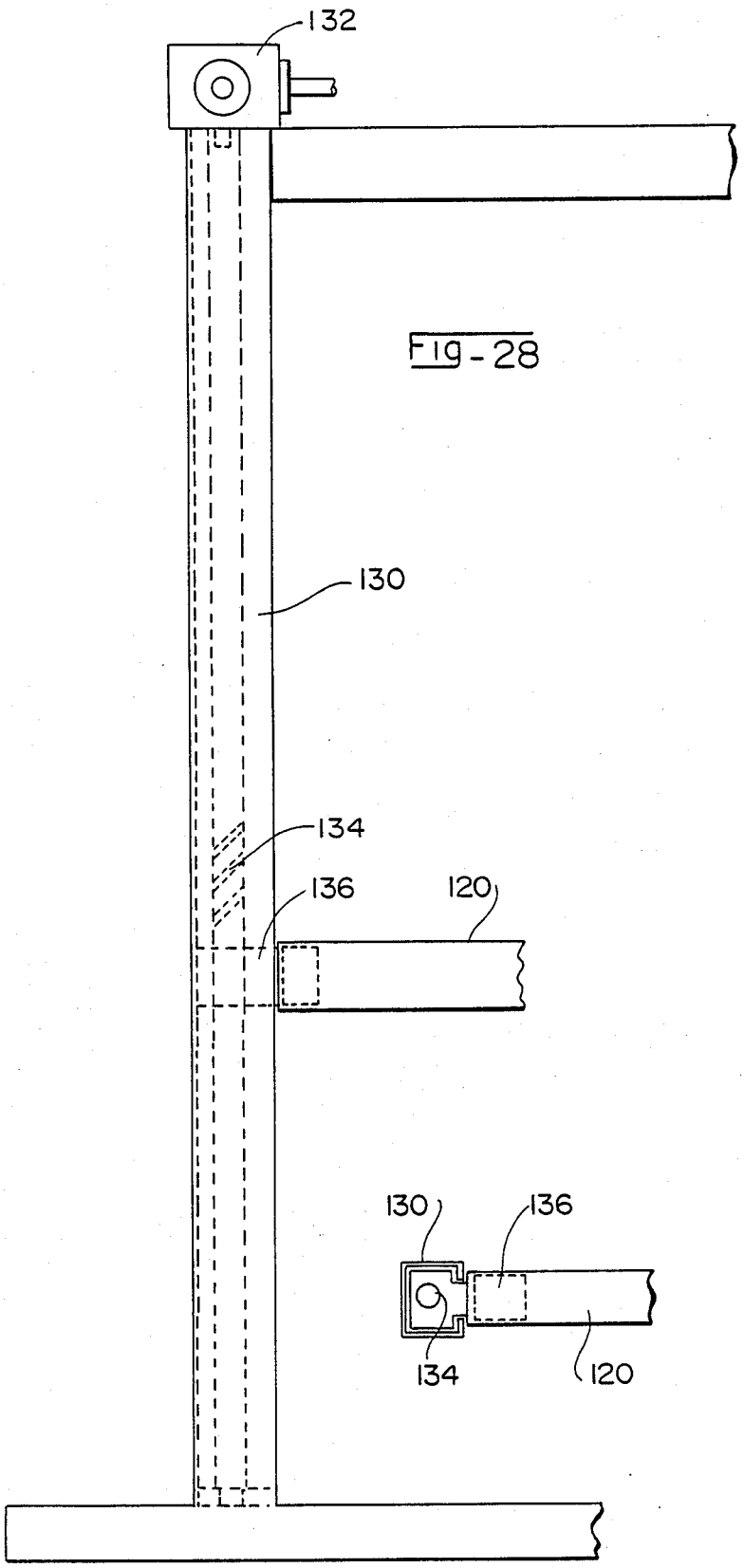
FIG. 28 illustrates, in plan, the vertical lifting structure of a canister transposition mechanism.

Arm 120 can be lifted in a conventional manner, e.g., by a drive motor and screws driven by a right-angle screw drive. A similar assembly can be provided to move the arms laterally. One lifting assembly is illustrated in FIG. 28, and comprises a column 130, right angle gear drive 132, a screw 134, and a connector 136 threadably connected at one end to screw 134 and attached at another end to support arm 120. A lateral moving assembly is shown in FIG. 28, and comprises a column 138 for supporting arms 112, 114, 116 and 118, and a welded connector 139 which rigidly supports a tube 140. A right angle gear drive 140 is attached, via one drive shaft, to screw 141, which extends within tube 140. A threaded block 142 is attached to second tube 143, which is snugly fit within tube 140. Rotation of the drive shaft rotates block 142, causing tube 143 to move outwardly away from column 138 or retract into tube 140 to move the arms. Arms 112, 114, 116 and 118 each comprise a plurality of spaced fingers, with arm 120 having similarly spaced, offset fingers which can be positioned at the same level as arms 112, 114, 116 and 118.

The irradiator of the present invention uses source elements which are formed in arrays of generally parallel elements which are vertically and horizontally arranged with respect to the plane of motion of the canisters. These source element arrays are constructed similarly to a roller chain, with each rod-like source element 97 being held freely at each of its ends within respective metal cup recesses 90 at the joining of chain links 92, as clearly illustrated in FIGS. 18 and 20. One embodiment such as that in FIG. 17, includes two overall chain arrays 91 and 93, similar to that of FIG. 27, each of which includes two spaced chains travelling in respective tracks. Separator or spacer rods 96, which are located at appropriately spaced points along the chain link array C, are arranged in order to provide structural rigidity to the assembly. An example of such spacing is best illustrated in FIG. 19. When the irradiator is shut down, the source element arrays are all moved to a position in which they are fully submerged at a depth within a pool which is sufficient to enable the water to provide the operator with protection while within the irradiation area. During irradiation, the source elements are lifted through a system of pulleys and cables so that the source elements will be located in planes permitting simultaneous irradiation of two walls of each canister. The source arrays are then pulled up vertically from the pool water along track guides (see FIGS. 26 and 27) which position the source element arrays accurately between canisters. The source elements can then provide irradiation to canisters along both faces of the source element array.

Sufficient source element arrays are provided which can be raised, through the use of pulleys and cables, along curved tracks so that the chain-like system can be positioned to irradiate the bottom of the upper canisters and the top of the lower canisters. By using these types of arrays each canister will be irradiated on all four sides during the movement of each pair of canisters along the lower level and along the upper level. By continuously moving these canisters past the sources, each canister side will receive a substantially uniform irradiation dose along the length of the canisters. The source arrays are sized so that direct irradiation is received by each canister target only over approximately two-thirds of the total width of the canister. Each side of the canister is similarly approximately two-thirds irradiated.

If uniform irradiation occurred across the vertical dimension of one side of the canister and across the full horizontal dimension of either a bottom or top of the canister, one would expect to find that in the corner of each canister high radiation doses would develop. By keeping active source element arrays smaller than an entire side or an entire bottom or top of the canister, dosage levels will taper off towards the corners of the canisters and operators will be able to attain a dosage level at each corner which is more closely equal to the level at the center of a top, bottom or side of the canister. More specifically, the depth dose from the outside of the canister towards the center of the canister can be reduced by as much as 8 to 1 and still provide a predetermined and satisfactory maximum to minimum ratio of no greater than 2:1. This can be achieved with product densities of approximately 0.7 grams/cc and less. Such a ratio would be acceptable for irradiating produce; and the present irradiator is thus capable of providing an efficient and uniform irradiation of targets of large cross-section on a relatively high input basis. Alternately (or additionally) reinforcing corners 16 can be made sufficiently thick to absorb the increased radiation at the canister corners; or a higher gamma-ray absorption cross-sectional material can be laminated to the interior of the corners, e.g., lead or steel could be used.

No labor or machinery and equipment is necessary to unload, de-palletize, re-palletize or reload cartons of products. The mechanisms used are quite simple and will move the product through an irradiator at speeds which are entirely manageable with readily attainable mechanical and material handling devices. For a throughput of approximately 100,000 pounds per hour, a total of ten canisters will be necessary to irradiate produce having a density of about 0.7 grams/cc. This translates to a six minute movement period per canister to move each canister through the irradiator. Since four canisters are processed simultaneously, a truckload of material would reside within the irradiator for about 24 minutes and for about an equal amount of time during its transfer from the unloading building, through the conveyor tunnels and back out to the loading building.

It is clear that the present system provides a large number of unique advantages. The system provides for easily loading products into and out of canisters at the packing plant as well as at a point of sale. This results in substantial time and labor savings at both locations during the transfer of produce or other food products. The canisters can provide for proper environmental atmosphere and temperature control in order to ensure that food products will receive a beneficial environment and so that ripening time and storage life can be controlled. By placing four canisters at a time in a structural assembly, e.g., a rack, the entire assembly can be disconnected from the trailer bed and transferred aboard a ship for ocean shipment of a product. This minimizes damage to food products and permits the system to be used to transfer canister arrays to railroad flatbeds.

The design of the irradiator and canisters permits easy transfer of large quantities of produce or other food products directly from a tractor trailer through an irradiator where the canisters are irradiated without unloading product, handling product, de-palletizing or palletizing cartons. In this fashion, optimum irradiation conditions can be provided, with relatively low max/-min ratios for targets of large cross-section and so that maximum efficiency in utilizing gamma-radiation emitted from radioactive source elements can be achieved.

Further, no need for warehousing and cold storing products is required as long as the irradiator uses the canister system, unlike systems where irradiators also handle pallets and cartons.

During transportation to market after irradiation, the canisters may receive appropriate cover gases in order to control product ripening. Further, liquid nitrogen could be pumped into the canisters if desired to maintain below ambient temperatures in the canisters.

It is clear from the above that other embodiments and features of the present invention could be used which would be within the skill of those of ordinary skill in the art and within the scope of the present invention.

What is claimed is:

1. A gamma radiation irradiator having first and second end walls including a path for conducting a plurality of product-containing canisters, each of said canisters having at least four sides, said irradiator comprising:

(a) an entry opening for receiving said canisters from a first conveyor;

(b) an elevator for raising said canisters from said entry opening, said elevator being located adjacent said entry opening;

(c) a primary irradiation zone for irradiating said canisters, said primary irradiation zone including an irradiation source and being located along a central longitudinal portion of said irradiator between said first and second end walls;

(d) a second conveyor positioned over substantially the entire length of said irradiator, said second conveyor comprising means for transporting said canisters a first time and a second time through said primary irradiation zone;

(e) means for changing the positions of said canisters with respect to each other on said second conveyor between said first time and said second time that said canisters are transported through said primary irradiation zone, two walls of each said canister being directly radiated during said first time through said primary irradiation zone and two other walls of each said canister being directly irradiated during said second time through said primary irradiation zone so that each of the at least four sides of said canisters are substantially uniformly irradiated after each of said canisters has been transported said first and second times through said irradiation zone; and (f) an elevator for lowering said canisters from said second conveyor to an exit opening, said exit opening comprising means for permitting said canisters to travel from said irradiator to a third convey outside of said irradiator.

2. An irradiator in accordance with claim 1 wherein said elevator for raising said canisters comprises means for simultaneously raising a first canister and a second canister to said second conveyor, and wherein said elevator for lowering said canisters comprises means for later lowering said first and second canisters simultaneously from said second conveyor to said third conveyor.

3. An irradiator in accordance with claim 1 wherein said primary irradiation zone includes an irradiation source comprising means for emitting radiation, an irradiation source storage pool for selectively storing said irradiation source, and means for moving said radiation source between an inoperative position within said radiation source storage pool and an operative position upwardly from said radiation source pool.

4. An irradiator in accordance with claim 3 wherein said radiation source moving means comprise a cable and pulleys for guiding and lifting a plurality of radiation sources together.

5. An irradiator in accordance with claim 3 wherein said radiation source means comprises at least two source holding plaques, each of said plaques holding a plurality of rod-like radiation source elements, said plaques together comprising means for irradiating at least one side wall of each of four product containing canisters simultaneously, and for simultaneously irradiating the bottom walls of two canisters positioned on an upper level of said second conveyor and the top walls of two canisters positioned on a lower level of said second conveyor.

6. An irradiator in accordance with claim 5 further comprising one set of pulleys and cables to which each of said source plaques are attached, said sets of pulleys and cables comprising means for raising and lowering said source plaques between said operative and said inoperative radiation positions.

7. An irradiator in accordance with claim 6 wherein each of said source plaques comprises a plurality of chain links connected by joints to form a chain, each of said joints having a cup-shaped metal recess, one radiation source element being freely positioned within a respective one of said cup-shaped metal recesses, said chain further comprising a plurality of spaced separator rods connecting respective chain pairs.

8. An irradiator in accordance with claim 1 wherein said irradiator comprises a substantially continuous outer wall made from concrete.

9. An irradiator in accordance with claim 1 wherein said second conveyor comprises a lower conveyor section for simultaneously transporting at least two canisters through a lower portion of said irradiation zone and an upper conveyor section for simultaneously transporting said at least two canisters through an upper portion of said irradiation zone.

10. An irradiator in accordance with claim 9 wherein both of said upper and lower conveyor sections comprise roller conveyors.

11. An irradiator in accordance with claim 9 further comprising means for transposing the position of two canisters between said upper and lower conveyor sections.

12. An irradiator in accordance with claim 11 said transposing means comprising a frame, a plurality of arms retractable from the interior of said frame, and means for raising and lowering said canisters while within said frame.

13. An irradiator in accordance with claim 1 wherein said elevator for raising said canisters and said elevator for lowering said canisters are two separate elevators.

14. A method of irradiating a plurality of product-containing canisters, each of said canisters holding a plurality of product-containing cartons, each of said canisters having at least four sides, said method comprising:

(a) positioning a plurality of carton-holding canisters on a truck trailer bed;
(b) transferring said canisters from said trailer bed to a gamma radiation irradiator;
(c) conducting said canisters through said irradiator to expose said products to irradiation within predetermined maximum and minimum limits;
(d) conducting said canisters from said irradiator to a truck trailer bed;
(e) conducting said canisters to said irradiator underground with a first conveyor and then lifting said canisters, by a first irradiator elevator, to a second conveyor within said irradiator; and
(f) conducting said canisters along a lower irradiation path portion and a upper irradiation path portion past an irradiation source two side of said canisters being directly irradiated when said canisters are conducted along one of the lower or upper irradiation path repositioning said canisters with respect to each other so that two other sides of said canisters are directly irradiated when said canisters are conducted along the other of the lower or upper irradiation path so as to substantially uniformly expose all of said at least four sides of said canisters to radiation, thereafter using a second elevator to lower said canisters to an irradiator exit below ground level.

15. A method in accordance with claim 14 further comprising conducting said irradiated canisters from said irradiator exit to a loading station where said canisters are loaded onto a trailer truck bed.

16. A method in accordance with claim 14 wherein said canisters are irradiated in said irradiator by at least two radiation source plaques, each of said canisters having an upper surface, a lower surface and first and second side surfaces, said canisters being conducted in pairs along a lower radiation path portion in which said upper surface and first side surfaces of each canister are irradiated by said source plaques and along an upper radiation path portion along which said lower wall and a second side of each canister are irradiated by said source plaques.

17. A method of handling a plurality of product-containing cartons in an irradiator, said method comprising;

(a) positioning said plurality of product-containing cartons in a canister having upper and lower walls, first and second opposed sides, and first and second open ends;
(b) closing the open ends of said canister;
(c) transporting said canister through an irradiation path a first and second time within an irradiation building, directly irradiating only two of the sides of said canister with gamma radiation when the canister is transported through the irradiation path the first time, repositioning said canister, directly irradiating two other sides of the canister with gamma radiation when the canister is transported through the irradiation path the second time, so as to substantially uniformly expose the walls and sides of said canister to radiation; and
(d) unloading said irradiated product-containing cartons from said canister.

18. A method in accordance with claim 17 wherein said cartons are positioned within said canister by using hydraulic lifters which lift one open end of said canister above the second end of said canister, and thereafter slowly sliding cartons into said canister.

19. A method in accordance with claim 18 further comprising reducing the coefficient of friction of the inside lower surface of said canister by vibrating said inside lower surface as said cartons are positioned within said canister.

20. A method in accordance with claim 18 further comprising nesting individual cartons within each other on the interior of said canister.

21. A method in accordance with claim 17 wherein said plurality of cartons are positioned within said canister by:

(a) stacking said cartons onto a plurality of assemblies of product-containing cartons;

(b) raising said canister so that the longitudinal axis of said canister is in a substantially vertical position;

(c) lowering said canister over said assemblies to enclose said assemblies; and (d) tipping said filled canister into a horizontal position.

22. A method in accordance with claim 21 wherein said step of unloading said canister comprises the step of tipping said filled canister into a substantially vertical position and lifting said canister off of said assemblies.

23. A method in accordance with claim 17 wherein said cartons are positioned within said canister by pushing a first assembly of cartons into a closed end of said canister and thereafter pushing other assemblies as far into said canister as possible into positions adjacent said first assembly of cartons, thereafter repeating said assembly pushing with additional assemblies until said canister is filled.

24. A method in accordance with claim 17 wherein said cartons are loaded into said canisters by positioning said cartons within a substantially parallelepipedic box having a low coefficient of friction and dimensions smaller than the dimensions of said canister, each of said boxes comprising male and female latching members which are adapted to engage each other when two of said boxes are positioned adjacent to each other within said canister.

25. A method in accordance with claim 24 wherein said canister is unloaded by pulling on corners of each of said boxes until said carton-containing boxes are unlatched from each other and removed from said canister.

26. A method in accordance with claim 24 wherein said canister is unloaded by opening one end of said canister and pushing on corners of said boxes until said boxes are unlatched from each other and pushed outwardly of said canister.

27. A system for carrying out an irradiation process, said system comprising:

(a) at least one canister having at least four sides;

(b) an irradiator source of gamma radiation positioned to irradiate at least two of said at least four sides of said canister simultaneously;

(c) a plurality of buildings, one of said buildings housing said irradiation source; and (d) means for conducting each said canister past said irradiator source, a first and second time said conducting means further comprising means for repositioning each said canister after said first time so that only two of said sides of said canister are substantially directly uniformly irradiated while each said canister has been conducted past said irradiator source the first time and two other sides of said canister are substantially directly irradiated while said at least one canister has been conducted past said irradiator source the second time.

28. The system of claim 27 wherein a second one of said buildings comprises a canister unloading facility.

29. The system of claim 27 wherein a third one of said buildings comprises a canister reloading facility.

30. The system of claim 27 wherein each of the two passes occur on different levels.

31. The system of claim 29 wherein one of said two passes is directly on top of the first of said two passes.

* * * * *